US011436988B2

(12) United States Patent
Ishii

(10) Patent No.: US 11,436,988 B2
(45) Date of Patent: Sep. 6, 2022

(54) CONTROL METHOD AND CONTROL DEVICE

(71) Applicant: JOLED INC., Tokyo (JP)

(72) Inventor: Hiroaki Ishii, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/091,654

(22) Filed: Nov. 6, 2020

(65) Prior Publication Data

US 2021/0142742 A1 May 13, 2021

(30) Foreign Application Priority Data

Nov. 12, 2019 (JP) ..... JP2019-204934
Sep. 15, 2020 (JP) ..... JP2020-154930

(51) Int. Cl.
*G09G 5/10* (2006.01)
*G09G 3/34* (2006.01)
*G09G 3/20* (2006.01)

(52) U.S. Cl.
CPC ..... *G09G 3/3413* (2013.01); *G09G 3/2003* (2013.01); *G09G 2320/064* (2013.01); *G09G 2320/0666* (2013.01)

(58) Field of Classification Search
CPC .. G09G 3/3413; G09G 3/3258; G09G 3/3275; G09G 3/3266; G09G 3/2003; G09G 2310/0264; G09G 2310/0283; G09G 2320/064; G09G 2320/0626;
(Continued)

(56) References Cited

U.S. PATENT DOCUMENTS

2002/0017643 A1 2/2002 Koyama
2003/0058195 A1 3/2003 Adachi et al.
(Continued)

FOREIGN PATENT DOCUMENTS

JP 2002-175039 6/2002
JP 2006-030516 2/2006
(Continued)

OTHER PUBLICATIONS

Extended European Search Report from European Patent Office (EPO) in European Pat. Appl. No. 20206427.5, dated Mar. 30, 2021.

*Primary Examiner* — Jennifer T Nguyen
(74) *Attorney, Agent, or Firm* — Greenblum & Bernstein, P.L.C.

(57) ABSTRACT

A control method or the like is provided capable of suppressing a flicker phenomenon even if frame periods vary in length. The control method is for controlling an emission period and an extinction period of a frame period, which is a period in which one image continues to be displayed. When a signal indicating start of a frame period is detected, as the frame period, n subframe periods that configure the frame period, where n is an integer greater than or equal to 2, are sequentially started from the first subframe period, after a predetermined period of time has elapsed since the detection of the signal. All of the n subframe periods are controlled to have a substantially same length determined in advance and to have a substantially same ratio between the emission period and the extinction period, determined in advance, the ratio being referred to as a duty ratio.

19 Claims, 32 Drawing Sheets

(58) Field of Classification Search
CPC ..... G09G 2320/02; G09G 2320/0233; G09G 2320/0666
USPC ..... 345/690
See application file for complete search history.

(56) References Cited

U.S. PATENT DOCUMENTS

| | | | | |
|---|---|---|---|---|
| 2007/0210993 | A1* | 9/2007 | Murakata | G09G 3/3291 345/76 |
| 2008/0048945 | A1* | 2/2008 | Jo | G09G 3/3233 345/76 |
| 2010/0214328 | A1* | 8/2010 | Hara | G09G 3/2025 345/690 |
| 2010/0231814 | A1 | 9/2010 | Yamada et al. | |
| 2011/0013099 | A1 | 1/2011 | Sugimoto | |
| 2013/0120478 | A1* | 5/2013 | Ishihara | G09G 3/2022 345/690 |
| 2018/0350304 | A1* | 12/2018 | Ishii | G09G 3/3258 |
| 2019/0014292 | A1 | 1/2019 | Ishii | |

FOREIGN PATENT DOCUMENTS

| | | |
|---|---|---|
| JP | 2011-022241 | 2/2011 |
| JP | 2019-015794 | 1/2019 |

* cited by examiner

CONTROL METHOD AND CONTROL DEVICE

CROSS REFERENCE TO RELATED APPLICATIONS

The present application is based on and claims priority of Japanese Patent Application No. 2019-204934 filed on Nov. 12, 2019 and Japanese Patent Application No. 2020-154930 filed on Sep. 15, 2020. The entire disclosure of the above-identified application, including the specification, drawings and claims is incorporated herein by reference in its entirety.

FIELD

The present disclosure relates to a control method and a control device, and in particular to a control device and a control method for controlling the display luminance of a display.

BACKGROUND

In displays using liquid crystals or organic EL devices, for example, it is known that flicker (flickering) becomes visible as the refresh rates get lower, whereas flicker becomes almost invisible as the refresh rates get higher up to about 72 Hz.

Moreover, displays using organic EL devices have an extinction period because they necessitate temporarily turning off a display and resetting pixels in order to update pixel information. This extinction period occupies a given period of time in one frame period. One frame period is a period in which one screen (image) continues to be displayed. Although the luminance may be adjusted by changing the ratio between an emission period and the extinction period, the displays using organic EL devices may have visible flicker depending on the ratio (duty ratio) between the emission period and the extinction period of one frame period even if they provide a video display at a refresh rate of 60 Hz, for example.

In view of this, Patent Literature (PTL) 1, for example, discloses a technique for changing the number of subframes that configure one frame period in accordance with the duty ratio set corresponding to luminance information and thereby making the duty ratio for each subframe the same as the duty ratio for one frame period. This suppresses the occurrence of flicker on a display screen even if the emission period has been changed by, for example, brightness control.

CITATION LIST

Patent Literature

PTL 1: Japanese Unexamined Patent Application Publication No. 2006-30516

SUMMARY

Technical Problem

In recent years, video imaging on displays of devices, such as personal computers and mobile devices, has become more commonly performed by video image processors called graphics processing units (GPUs). The refresh rates of display for such displays have been more commonly determined by the performance of the GPUs. In other words, it has become more common in recent years to vary frame periods (frame rates) depending on the contents processed by the GPUs.

However, there is a problem in that the conventional technique disclosed in PTL 1 is based on the assumption that the frame periods are fixed.

More specifically, with the conventional technique disclosed in PTL 1, the duty for the frame periods is set on the basis of the luminance information and the number of vertical lines on a display screen expected in advance, and the number of subframes that configure one frame period is determined according to the set duty ratio. However, when frame periods vary in length, e.g., when a frame period is long (i.e., a frame rate is low), subframe periods also become long and accordingly the emission period and an extinction period become long. This allows human eyes to readily recognize switching between emission and extinction, i.e., flashing, and visually identify flicker.

The present disclosure has been made in view of the above circumstances, and it is an object of the present disclosure to provide a control method and a control device that enable suppressing a flicker phenomenon even if frame periods vary in length.

Solution to Problem

In order to achieve the object described above, a control method according to one aspect of the present disclosure is a control method for use in a case where frame periods, each being a period in which one image continues to be displayed, vary in length within a given range or temporarily become stable in length on a frame-by-frame basis, and accurate lengths of the frame periods are not known beforehand. The control method includes displaying an image by changing, irrespective of a frame period that is input, a total number of subframe periods so that the frame period is reconfigured as n subframe periods, where n is an integer greater than or equal to 2.

This makes flicker invisible on the display panel for displaying an image, even if frame periods widely vary in length. That is, it is possible to suppress a flicker phenomenon even if frame periods vary in length.

Also, a control method for use in a case where frame periods, each being a period in which one image continues to be displayed, vary in length within a given range or temporarily become stable in length on a frame-by-frame basis, and accurate lengths of the frame periods are not known beforehand, includes changing, irrespective of a frame period that is input, a total number of subframe periods so that the frame period is reconfigured as n subframe periods, where n is an integer greater than or equal to 2, and when a signal indicating start of a next frame period is detected during an added subframe period that is executed after a last subframe period and if timing of the detection is within a period of time less than or equal to a given threshold value after start of one subframe period, stopping the added subframe period before the added subframe period ends and starting the next frame period.

In the case where a signal such as a vertical synchronizing signal has been detected within a period of time less than or equal to the threshold value after the start time of the added subframe period, the added subframe period is stopped before the added subframe period ends, and the first subframe period of the next frame period is started. This increases the length of one frame period, but sufficiently reduces variations in luminance if the range of increase in length is small. Accordingly, it is possible to suppress a flicker phenomenon even if frame periods vary in length.

Each of the n subframe periods may be controlled to become a period of a substantially same length determined in advance.

When a signal indicating start of a frame period is detected during a subframe period, n subframe periods that configure the frame period, where n is an integer greater than or equal to 2, may be sequentially executed from a first subframe period, as the frame period, after a predetermined period of time has elapsed since the detection of the signal.

When a signal indicating start of a next frame period after the frame period is detected during execution of a last subframe period of the n subframe periods, the predetermined period of time may be a period of time from the detection of the signal indicating the start of a next frame period during the last subframe period to an end of the last subframe period.

A signal indicating start of a frame period that has been detected may be a vertical synchronizing signal or a video period signal at a frame head.

Accordingly, one frame period can be determined using the detection of a vertical synchronizing signal or a video period signal at a frame head as a starting point.

When a signal indicating start of a next frame period after the frame period has not been detected during execution of a last subframe period of the n subframe periods, it may be determined that the frame period is not an integral multiple of the subframe periods and another subframe period is further started after the end of the last subframe period.

When a signal indicating start of a next frame period after the frame period has not been detected during execution of a last subframe period of the n subframe periods, it may be determined that the frame period has not ended yet, and an other subframe period is further started after the end of the last subframe period.

When the start of the next frame period has not been detected, the other subframe period may be repeatedly executed.

In this way, even if the frame period is not an integral multiple of subframe periods of a predetermined length, the emission period and the extinction period can be repeated at fixed intervals, using the plurality of subframe periods. This makes flicker invisible. That is, it is possible to suppress a flicker phenomenon even if frame periods vary in length.

The frame period may be compliant with a standard that makes start timing of imaging variable in accordance with a processing time of a GPU, and a total number of subframes that configure a frame period may vary dynamically in accordance with an input video signal.

This makes the control method compliant with standards such as Adaptive-Sync standards that define the specifications of video synchronizing signals for the case where the frame periods have variable lengths, or compliant with G-SYNC and Free Sync that are defined as authentication standards by GPU vendors. Accordingly, it is possible to suppress the occurrence of flicker while following wide synchronous variations.

Each of the n subframe periods may include an emission period and an extinction period.

A ratio between the emission period and the extinction period may be controlled to become a substantially same ratio determined in advance, the ratio being referred to as a duty ratio.

The duty ratio for each of the n subframe periods that configure the frame period may be adjusted in accordance with a light-emitting property of a display panel that displays the image.

By adjusting the duty ratio for each of the plurality of subframe periods, it is possible to reduce a situation in which mean luminance during each of the plurality of subframe periods that configure one frame period may be deviated from target luminance due to a light-emitting property unique to the display panel. Accordingly, it is possible to suppress a flicker phenomenon while suppressing the influence of the light-emitting property unique to the display panel.

In a case of adjusting the duty ratio for each of the n subframe periods, the duty ratio may be adjusted to make the emission period following the extinction period of a first subframe period of the n subframe periods shorter than a length determined by the substantially same ratio.

This suppresses the influence of an overshoot caused by the light-emitting property unique to the display panel. Accordingly, it is possible to suppress a flicker phenomenon while suppressing the influence of the light-emitting property unique to the display panel.

The extinction period of a first subframe period of the n subframe periods may include an initialization period for initializing a plurality of pixel circuits arranged in a matrix and included in a display panel that displays the image.

In this way, by including the initialization period for initializing the plurality of pixel circuits in the extinction period that starts at the beginning of the frame period, it is possible to provide a proper video display during the frame period.

Moreover, pixels included in a display panel that displays the image may be light-emitting devices including an organic EL device and driven by current to emit light.

Accordingly, even if frame periods widely vary in length due to the processing capabilities of GPUs or other factors, it is possible to make flicker invisible on the display panel using OLEDs. That is, it is possible to suppress a flicker phenomenon in the display panel using OLEDs even if frame periods vary in length.

Moreover, pixels included in a display panel that display the image may be liquid crystal devices, each of the n subframe periods may include an emission period and an extinction period, the emission period may be a period in which a backlight for backlight scanning is on, and the extinction period may be a period in which the backlight is off.

Accordingly, even if frame periods for backlight scanning widely vary in length, it is possible to make flicker invisible on the display panel using liquid crystals. That is, it is possible to suppress a flicker phenomenon on the display panel using liquid crystals, even if frame periods for backlight scanning vary in length.

In order to achieve the object described above, a control device according to one aspect of the present disclosure is a control device for controlling an emission period and an extinction period of a frame period that is a period in which one image continues to be displayed. The control device includes a duty controller that, when having detected a signal indicating start of a frame period, sequentially starts, as a frame period, a plurality of subframe periods that configure the frame period, from a first subframe period after a predetermined period of time has elapsed since the detection of the signal. The duty controller controls all of the plurality of subframe periods to have a substantially same length determined in advance and to have a substantially same ratio between the emission period and the extinction period, the ratio being referred to as a duty ratio.

Accordingly, the extinction period of the frame period can be distributed among the plurality of subframe periods. That is, the emission period and the extinction period can be repeated at fixed intervals, using the plurality of subframe periods. Accordingly, even if frame periods widely vary in length, flicker is made invisible on the display panel for displaying an image. That is, it is possible to suppress a flicker phenomenon even if frame periods vary in length.

Advantageous Effects

The control method and the control device according to the present disclosure can suppress a flicker phenomenon even if frame periods vary in length.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENT(S)

Embodiment 1

Hereinafter, embodiments of the present disclosure will be described with reference to the drawings. Any embodiment described below is a preferable specific example of the present disclosure. Thus, numerical values, shapes, materials, constituent elements, locations of constituent elements and the form of connection in the following embodiments are merely one example, and do not intend to limit the present disclosure. Among the constituent elements given in the following embodiments, those that are not recited in any of the independent claims, which represent the broadest concept of the present disclosure, are described as optional constituent elements.

Note that each drawing is given in schematic form and does not always provide precise depiction. In each drawing, substantially the same configuration is given the same reference sign, and a redundant description thereof shall be omitted or simplified.

Embodiments

First, a configuration of a display device that includes a control device according to the present disclosure will be described. The present embodiment describes, as an example, a case where organic electro luminescence (EL) devices are used in the display device.

[1. Configuration of Display Device]

Figure 1:
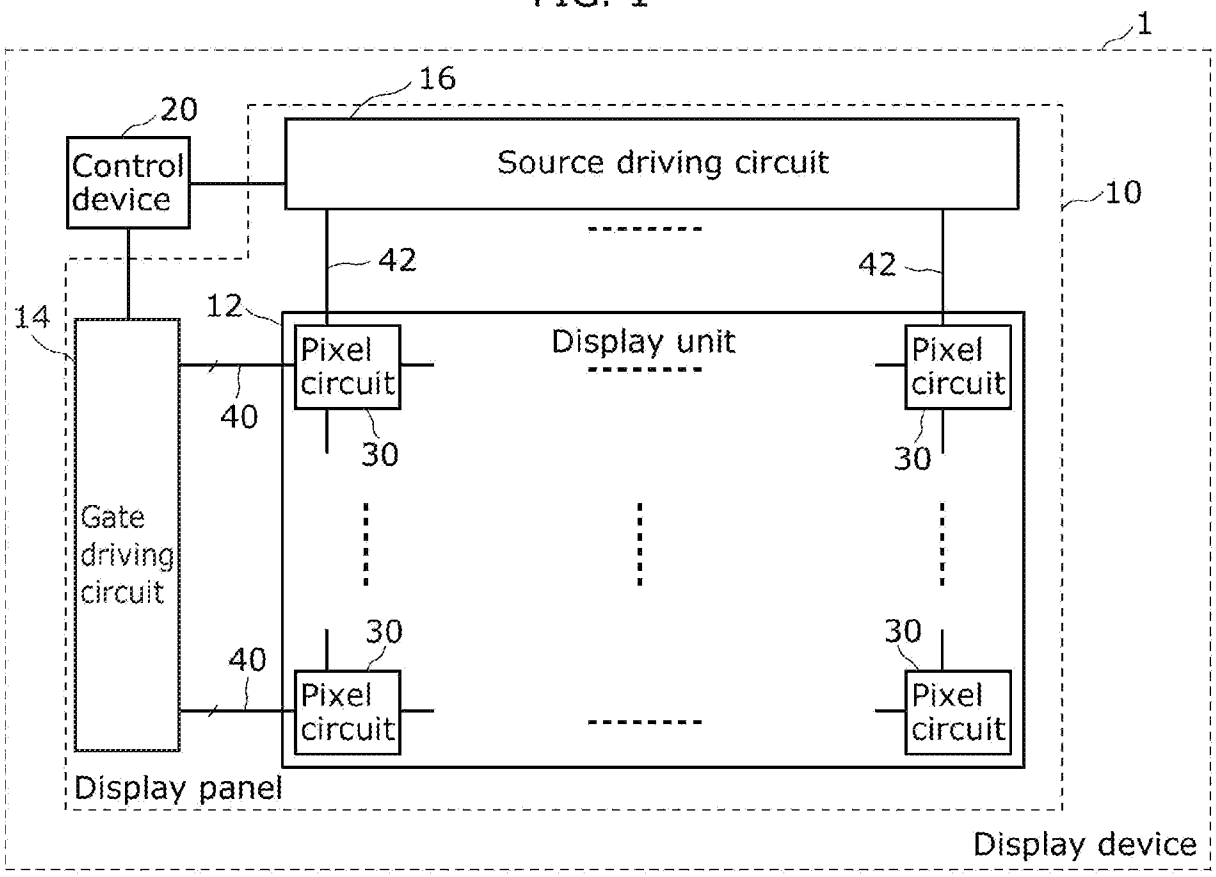
FIG. 1 is a schematic diagram illustrating a configuration example of a display device according to an embodiment.

FIG. 1 is a schematic diagram illustrating a configuration example of display device 1 according to an embodiment of the present disclosure. As illustrated in FIG. 1, display device 1 includes display panel 10 and control device 20. For example, display device 1 is driven by a progressive drive system for an organic EL luminescent panel.

[2. Configuration of Display Panel]

As illustrated in FIG. 1, display panel 10 includes display unit 12 including a plurality of pixel circuits 30, and also includes gate driving circuit 14 and source driving circuit 16 as peripheral circuits of display unit 12. Note that display unit 12, gate driving circuit 14, source driving circuit 16, scanning lines 40, and signal lines 42 are mounted on, for example, a panel board (not shown) formed of glass or a resin such as an acrylic resin.

Display unit 12 displays video on the basis of video signals that are input from the outside to display device 1. As illustrated in FIG. 1, display unit 12 includes pixel circuits 30 arranged in a matrix, and has scanning lines 40 arranged in rows and signal lines 42 arranged in columns. Display unit 12 sequentially executes an initialization operation, a writing operation, and an emission operation for each row of pixel circuits 30.

Pixel circuits 30 are included in display panel 10 and arranged in a matrix. More specifically, each of pixel circuits 30 is arranged at a position of intersection between scanning line 40 and signal lines 42. This will be described later in detail.

Scanning lines 40 are arranged for each row of pixel circuits 30. One ends of scanning lines 40 are connected to pixel circuits 30, and the other ends of scanning lines 40 are connected to gate driving circuit 14.

Signal lines 42 are arranged for each column of pixel circuits 30. One ends of signal lines 42 are connected to pixel circuits 30, and the other ends of signal lines 42 are connected to source driving circuit 16.

Gate driving circuit 14 is also referred to as a scanning-line driving circuit and configured as, for example, a shift register. Gate driving circuit 14 is connected to scanning lines 40 and output gate control signals to scanning lines 40 so as to control turn-on and turn-off of each transistor included in pixel circuits 30. As the gate driving signals for controlling turn-on and turn-off of each transistor included in pixel circuits 30, gate driving circuit 14 according to the present embodiment outputs, for example, control signal WS, control signal REF, control signal INI, and extinction signal EN.

Source driving circuit 16 is also referred to as a signal-line driving circuit. Source driving circuit 16 is connected to signal lines 42 and outputs video signals supplied in units of frames from control device 20 to signal lines 42 so as to supply these video signals to each pixel circuit 30. Through signal lines 42, source driving circuit 16 writes luminance information based on the video signals to each pixel circuit 30 in the form of a current value or a voltage value. Note that the video signals input to source driving circuit 16 are, for example, digital serial data for each of three primary colors R, G, and B (video signals R, G, and B). Video signals R, G, and B input to source driving circuit 16 are converted into parallel data in units of rows inside source driving circuit 16. The parallel data in units of rows is further converted into analog data in units of rows indie source driving circuit 16 and is output as the video signals to signal lines 42.

[3. Configuration of Pixel Circuit]

Pixel circuits 30 are arranged in, for example, a matrix of N rows and M columns. N and M vary depending on the size and resolution of the display screen. For example, in the case where the display screen has a resolution called high definition (HD) and pixel circuits 30 corresponding to the three primary colors R, G, and B are adjacent in each row, N is at least 1080 rows and M is at least 1920×3 columns. In the present embodiment, each pixel circuit 30 includes organic EL devices as light-emitting devices.

Figure 2:
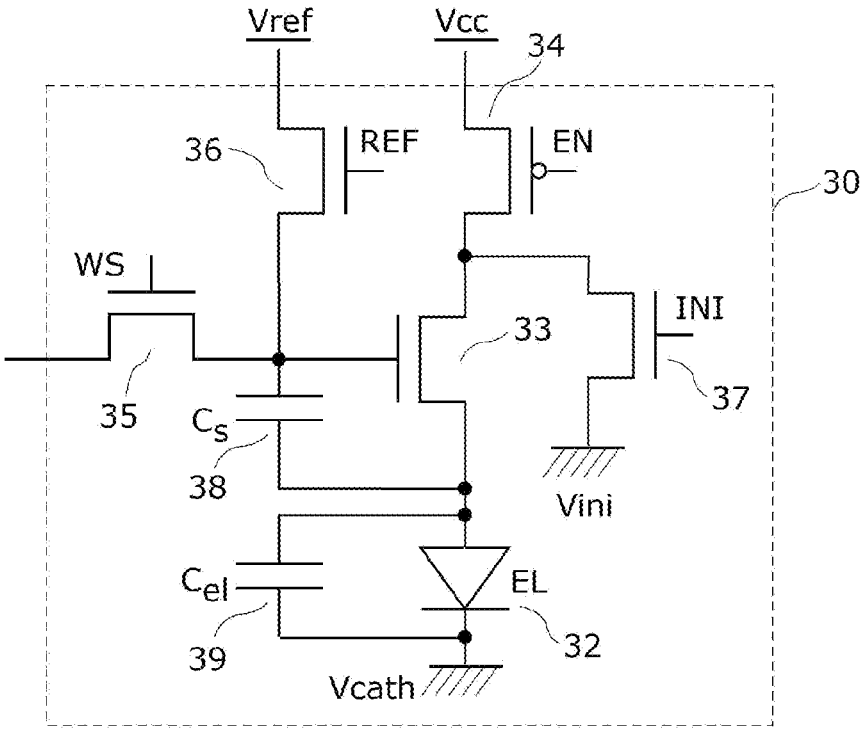
FIG. 2 is a circuit diagram schematically illustrating a configuration of one pixel circuit according to the embodiment.

FIG. 2 is a circuit diagram schematically illustrating a configuration of one pixel circuit 30 according to the present embodiment.

As illustrated in FIG. 2, pixel circuit 30 includes light-emitting device 32, drive transistor 33, selector transistor 35, switch transistors 34, 36, and 37, and pixel capacitance 38. In FIG. 2, pixel capacitance 38 is also expressed as Cs.

Light-emitting device 32 has its cathode connected to power source Vcath (negative power line) and its anode connected to the source of drive transistor 33. Due to a flow of current supplied from drive transistor 33 and corresponding to a signal voltage induced by the video signals, light-emitting device 32 emits light at a luminance corresponding to the signal voltage. Light-emitting device 32 is, for example, an organic EL device such as an organic light-emitting diode (OLED). Note that light-emitting device 32 is not limited to an organic EL device, and may be an inorganic EL device or a self-luminous device such as a QLED. Alternatively, light-emitting device 32 does not need to be a self-luminous device as long as it is a device driven and controlled by current.

Drive transistor 33 has its gate connected to, for example, one electrode of pixel capacitance 38, its drain connected to the source of switch transistor 34, and its source connected to the anode of light-emitting device 32. In FIG. 2, the source of drive transistor 33 is also connected to, for example, the other electrode of pixel capacitance 38. Drive transistor 33 converts the signal voltage applied between the gate and the source into current corresponding to the signal voltage (referred to as a "drain-source current"). When turned on, drive transistor 33 supplies the drain-source current to light-emitting device 32 and causes light-emitting device 32 to emit light. Drive transistor 33 is configured as, for example, an n-type thin film transistor (n-type TFT).

Switch transistor 34 has its gate connected to scanning line 40, one of its source and drain connected to power source Vcc, and the other of its source and drain connected to the drain of drive transistor 33. Switch transistor 34 is turned on or off in response to extinction signal EN supplied from scanning line 40. When turned on, switch transistor 34 connects drive transistor 33 to power source Vcc and causes drive transistor 33 to supply the drain-source current to light-emitting device 32. Switch transistor 34 is configured as, for example, an n-type thin film transistor (n-type TFT).

Selection transistor 35 has its gate connected to scanning line 40, one of its source and drain connected to signal line 42, and the other of its source and drain connected to one electrode of pixel capacitance 38. Selection transistor 35 is turned on or off in response to control signal WS supplied from scanning line 40. When turned on, selector transistor 35 applies the signal voltage induced by the video signals supplied from signal line 42 to the electrode of pixel capacitance 38 and causes pixel capacitance 38 to store the charge corresponding to the signal voltage. Selector transistor 35 is configured as, for example, an n-type thin film transistor (n-type TFT).

Switch transistor 36 has its gate connected to scanning line 40, one of its source and drain connected to power source Vref, and the other of its source and drain connected to, for example, one electrode of pixel capacitance 38. Switch transistor 36 is turned on or off in response to control signal REF supplied from scanning line 40. When turned on, switch transistor 36 sets the electrode of pixel capacitance 38 to a voltage of power source Vref (reference voltage). Switch transistor 36 is configured as, for example, an n-type thin film transistor (n-type TFT).

Switch transistor 37 has its gate connected to scanning line 40, one of its source and drain connected to the source of switch transistor 34 and the drain of drive transistor, and the other of its source and drain connected to power source Vini. Switch transistor 37 is turned on or off in response to control signal INI supplied from scanning line 40. When turned on under the condition that drive transistor 33 is in the ON state and switch transistor 34 is in the OFF state and not connected to power source Vcc, switch transistor 37 sets the anode of light-emitting device 32 to a voltage of power source Vini (reference voltage). Switch transistor 37 is configured as, for example, an n-type thin film transistor (n-type TFT).

Pixel capacitance 38 is a capacitor having one electrode connected to the gate of drive transistor 33, to the source of selector transistor 35, and to the source of switch transistor 36 and having the other electrode connected to the source of drive transistor 33. Pixel capacitance 38 stores the charge corresponding to the signal voltage supplied from signal line 42. After turn-off of selector transistor 35 and switch transistor 36, for example, pixel capacitance 38 stably holds the voltage between the gate and source electrodes of drive transistor 33. In this way, when selector transistor 35 and switch transistor 36 are in the OFF state, pixel capacitance 38 applies a voltage between the gate and source of drive transistor 33 in accordance with a signal potential induced by the accumulated charge.

EL capacitance 39 is a parasitic capacitance inherent in the EL device. After this capacitance is charged and the interelectrode voltage has increased, current flows toward the EL device, and the EL device starts to emit light.

Note that the conductivity type of each of drive transistor 33, selector transistor 35, switch transistor 36, and switch transistor 37 is not limited to the aforementioned type, and n-type and p-type TFTs may be mixed as appropriate. Each transistor is not limited to a polysilicon TFT, and may be configured as, for example, an amorphous silicon TFT.

Next, operations of pixel circuit 30 will be described.

Figure 3A:
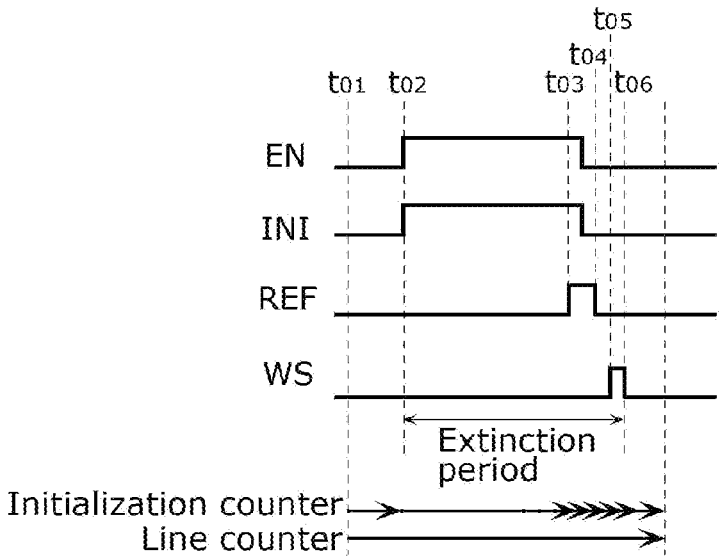
FIG. 3A is a timing chart illustrating an initialization operation of the pixel circuit illustrated in FIG. 2.

FIG. 3A is a timing chart illustrating an initialization operation of pixel circuit 30 illustrated in FIG. 2.

The initialization of pixel circuit 30 involves initializing light-emitting device 32 and EL capacitance 39 applying a reverse bias thereto and correcting (resetting) the voltage between the electrodes of pixel capacitance 38 in accordance with the discrepancy in the characteristic of drive transistor 33 before accumulating (writing) the charge corresponding to the signal voltage in pixel capacitance 38. An initialization period of pixel circuit 30 refers to a period in which light-emitting device 32 and EL capacitance 39 are initialized by the application of a reverse voltage, and the voltage between the electrodes of pixel capacitance 38 is corrected (reset) in accordance with the discrepancy in the characteristic of drive transistor 33. In the present embodiment, light-emitting device 32 does not emit light during the initialization period of pixel circuit 30. In other words, the initialization period of pixel circuit 30 is included in an extinction period (also referred to as a "non-luminous period").

More specifically, in pixel circuit 30, control signals WS, REF, and INI and extinction signal EN are all at the low level at time t01 before the start of the extinction period as illustrated in FIG. 3A. In this state, selector transistor 35 and switch transistors 36 and 37, which are n-type transistors, are in the OFF state. On the other hand, switch transistor 34, which is a p-type transistor, is in the ON state. That is, drive transistor 33 is in such a state that its drain is connected to power source Vcc via switch transistor 34 being in the ON state, its source is connected to the anode of light-emitting device 32, and its gate and source are connected to the electrodes of pixel capacitance 38. Since pixel capacitance 38 accumulates the charge corresponding to the signal voltage, drive transistor 33 supplies the gate-source current corresponding to the signal voltage to light-emitting device 32 and causes light-emitting device 32 to emit light.

Next, at time t02 when the extinction period starts, extinction signal EN and control signal INI are switched from the low level to the high level. As a result of extinction signal EN having been switched to the high level, switch transistor 34 is turned off and the drain of drive transistor 33 is disconnected from power source Vcc. Accordingly, light-emitting device 32 stops emitting light (extinction). Also, as a result of control signal INI having been switched to the high level, switch transistor 37 is turned on. The turn-on of switch transistor 37 connects the anode of light-emitting device 32 and one electrode of EL capacitance 39 to power source Vini via drive transistor 33 and causes a reverse bias to be applied to EL capacitance 39. This causes discharge of the capacitance and initializes the capacitance. Note that selector transistor 35, switch transistor 36, and switch transistor 34 remain in the OFF state.

Next, at time t03 when the initialization period starts, control signal REF is switched from the low level to the high level. As a result of control signal REF having been switched to the high level, switch transistor 36 is turned on, and the gate of drive transistor 33 and one electrode of pixel capacitance 38 are connected to power source Vref. Since control signal INI remains at the high level, switch transistor 37 also remains in the ON state. Accordingly, the gate of drive transistor 33 is connected to power source Vref and the source thereof is connected to power source Vini. Also, one electrode of pixel capacitance 38 is connected to power source Vref, and the other electrode thereof is connected to power source Vini. This causes discharge of pixel capacitance 38 and initializes pixel capacitance 38.

Thereafter, when switch transistor 34 and switch transistor 37 are turned off while switch transistor 36 remains in the ON state, one electrode of pixel capacitance 38 is connected to Vref, and the other electrode thereof is connected to Vcath via EL capacitance 39. The voltage between the electrodes of pixel capacitance 38 settles at the threshold voltage of drive transistor 33.

Next, at time t04 when the initialization period ends, control signal REF is switched from the high level to the low level. As a result of control signal REF having been switched to the low level, switch transistor 36 is turned off. Moreover, control signal INI and extinction signal EN are at the low level at time t04, so that switch transistor 34 is in the ON state, and switch transistor 37 is in the OFF state. That is, the drain of drive transistor 33 is connected to power source Vcc via switch transistor 34 being in the ON state, and the gate and source of drive transistor 33 are connected to the electrodes of pixel capacitance 38. However, since pixel capacitance 38 has been initialized as described above, drive transistor 33 does not cause light-emitting device 32 to emit light.

Next, at time t05, control signal WS is switched from the low level to the high level. As a result of control signal WS having been switched to the high level, selector transistor 35 is turned on and the signal voltage induced by the video signals transmitted via signal line 42 is written to pixel capacitance 38. Then, at time t06, the accumulation of the charge corresponding to the signal voltage induced by the video signals in pixel capacitance 38 has been completed. Thus, control signal WS is switched from the high level to the low level, and selector transistor 35 is turned off. Accordingly, light-emitting device 32 starts to emit light. That is, the extinction period ends.

Figure 3B:
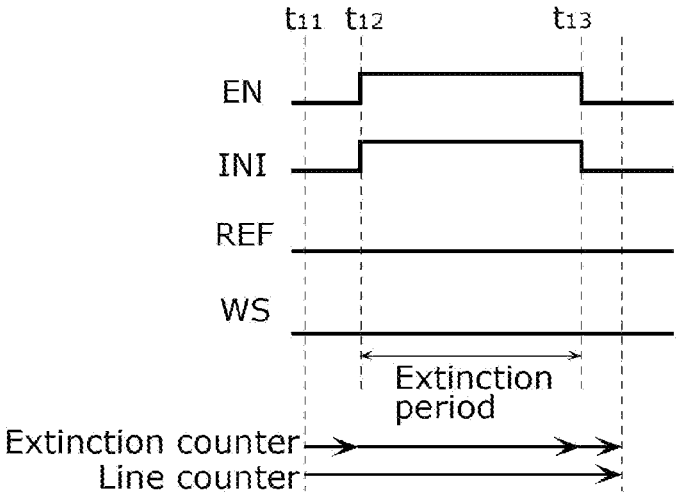
FIG. 3B is a timing chart illustrating an extinction operation of the pixel circuit illustrated in FIG. 2.

FIG. 3B is a timing chart illustrating an extinction operation of pixel circuit 30 illustrated in FIG. 2. In FIG. 3B, a case is illustrated in which pixel circuit 30 performs only the extinction operation without performing the initialization operation during the extinction period.

More specifically, at time t11 before the start of the extinction period in pixel circuit 30, control signals WS, REF, INI and extinction signal EN are all at the low level as illustrated in FIG. 3B. In this state, selector transistor 35, switch transistor 36, and switch transistor 37 are in the OFF state. On the other hand, switch transistor 34 is in the ON state. That is, drive transistor 33 is in such a state that its drain is connected to power source Vcc via switch transistor 34 being in the ON state, its source is connected to the anode of light-emitting device 32, and its gate and source are connected to the electrodes of pixel capacitance 38. Then, since pixel capacitance 38 has accumulated the charge corresponding to the signal voltage, drive transistor 33 supplies the gate-source current corresponding to the signal voltage to light-emitting device 32 and causes light-emitting device 32 to emit light.

Next, at time t12 when the extinction period starts, extinction signal EN and control signal INI are switched from the low level to the high level. As a result of extinction signal EN having been switched to the high level, switch transistor 34 is turned off and the drain of drive transistor 33 is disconnected from power source Vcc. Also, as a result of control signal INI having been switched to the high level, switch transistor 37 is turned on. The turn-on of switch transistor 37 connects the drain of the drive transistor to power source Vini. This stops drive transistor 33 from passing current to light-emitting device 32 and causes light-emitting device 32 to stop emitting light, i.e., become extinct. Note that selector transistor 35, switch transistor 36, and switch transistor 34 all remain in the OFF state.

Next, at time t13 when the extinction period ends, extinction signal EN and control signal INI are switched from the high level to the low level. As a result of extinction signal EN having been switched to the low level, switch transistor 34 is turned on and the drain of drive transistor 33 is connected to power source Vcc. Also, as a result of control signal INI having been switched to the low level, switch transistor 37 is turned off. Thus, drive transistor 33 is in such a state that its drain is connected to power source Vcc via switch transistor 34 being in the ON state, and its gate and source are connected to the electrodes of pixel capacitance 38. Then, since pixel capacitance 38 has accumulated the charge corresponding to the signal voltage, drive transistor 33 supplies the gate-source current corresponding to the signal voltage to light-emitting device 32 and causes light-emitting device 32 to start emitting light.

[4. Configuration of Control Device 20]

In the case where frame periods, each being a period in which one image continues to be displayed, vary in length within a given range or temporarily become stable in length on a frame-by-frame basis, and accurate lengths of the frame periods are not known beforehand, the control device according to the present disclosure performs control for displaying an image by changing, irrespective of a frame period that is input, the frame length of subframes so that the frame period is reconfigured as n subframes, where n is an integer greater than or equal 2. Hereinafter, control device 20 according to the embodiment will be described as one aspect of the present disclosure.

The following description is given of a configuration of control device 20 according to the present embodiment.

Figure 4:
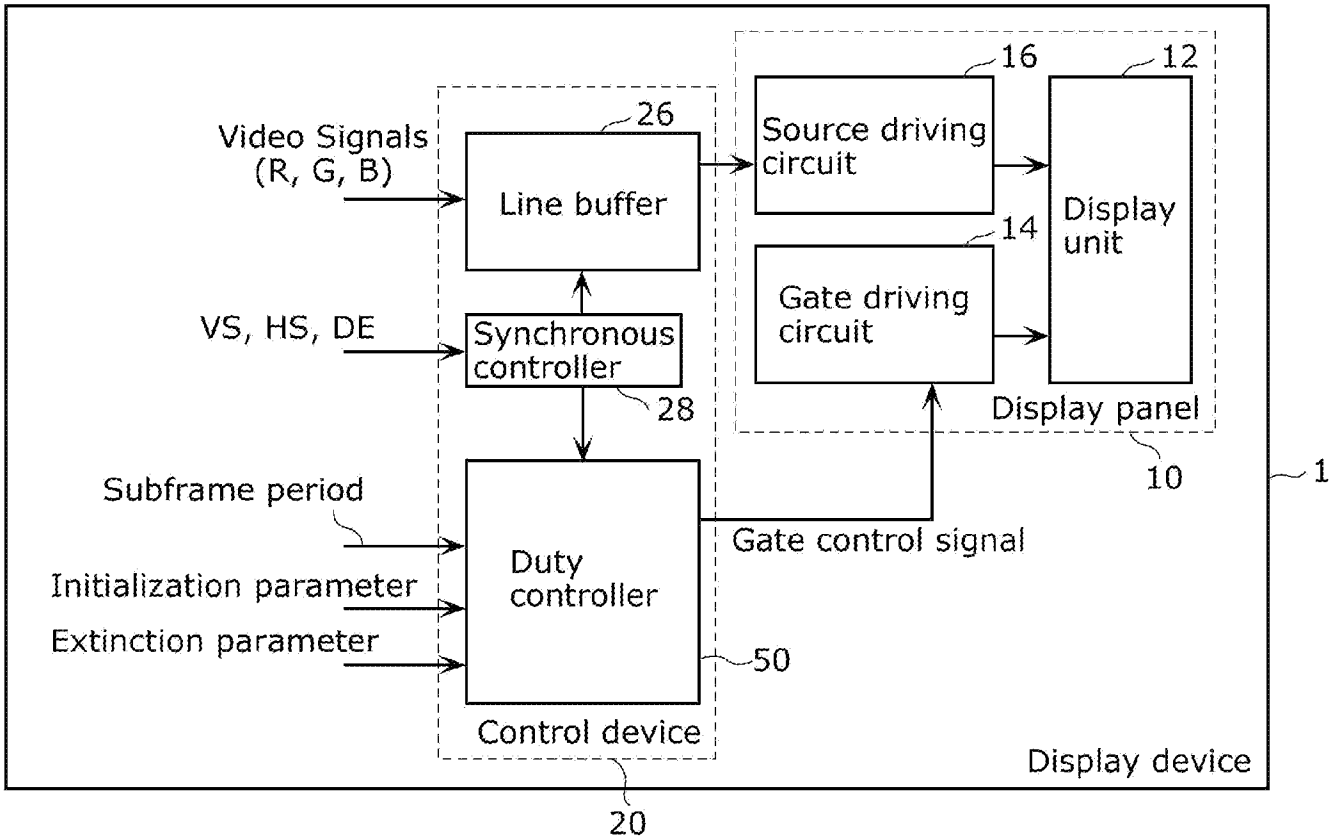
FIG. 4 is a block diagram illustrating a configuration of a control device included in the display device according to the embodiment.

FIG. 4 is a block diagram illustrating the configuration of control device 20 included in display device 1 according to the present embodiment.

Control device 20 is arranged outside display panel 10, e.g., formed on an external system circuit board (not shown), for example. Control device 20 has a function of, for example, a timing controller (TCON) and controls the overall operation of display device 1. Specifically, control device 20 outputs gate control signals to gate driving circuit 14, the gate control signals being generated based on vertical synchronizing signal VS, horizontal synchronizing signal HS, and video-period signal DE supplied from the outside. Control device 20 also supplies digital serial data about video signals R, G, and B to source driving circuit 16.

In the present embodiment, control device 20 controls at least the emission period and the extinction period of a frame period, which is a period in which one image continues to be displayed. By configuring one frame period of a plurality of subframe periods that repeat the emission period and the extinction period at fixed intervals, control device 20 can disperse (divide) the extinction period of the frame period. As illustrated in FIG. 4, control device 20 includes line buffer 26, synchronous controller 28, and duty controller 50.

Line buffer 26 is a buffer for temporarily holding video signals R, G, and B. Line buffer 26 sequentially holds video signals R, G, and B for each line received from the outside and outputs these signals to source driving circuit 16 with predetermined timing. For example, when the emission period has started, line buffer 26 reads out the video signals held therein and outputs these video signals to source driving circuit 16.

Synchronous controller 28 is a controller for controlling timing with which video signals R, G, and B are displayed on display unit 12. Synchronous controller 28 receives vertical synchronizing signal VS, horizontal synchronizing signal HS, and video-period signal DE from the outside and outputs these signals to duty controller 50 and line buffer 26.

Duty controller 50 generates gate control signals for controlling gate driving circuit 14 so that video signals R, G, and B are displayed on display unit 12 with desired timing. Duty controller 50 outputs the generated gate control signals to gate driving circuit 14. In the present embodiment, duty controller 50 detects the receipt of vertical synchronizing signal VS or video-period signal DE. Duty controller 50 also generates gate control signals for executing a plurality of subframe periods that repeat the emission period and the extinction period at fixed intervals. Although the details will be described later, when having detected a signal indicating the start of a frame period, duty controller 50 generates a gate control signal for executing an initialization period in the extinction period of the next subframe period after the subframe period being executed at the time of detection. In the other case, i.e., in the case where a signal indicating the start of a frame period has not been detected, duty controller 50 generates a gate control signal for repeatedly executing the subframe periods that include the emission periods and the extinction periods spaced at fixed intervals.

[5. Details of Duty Controller]

Hereinafter, duty controller 50 according to the present embodiment will be described in detail.

Figure 5:
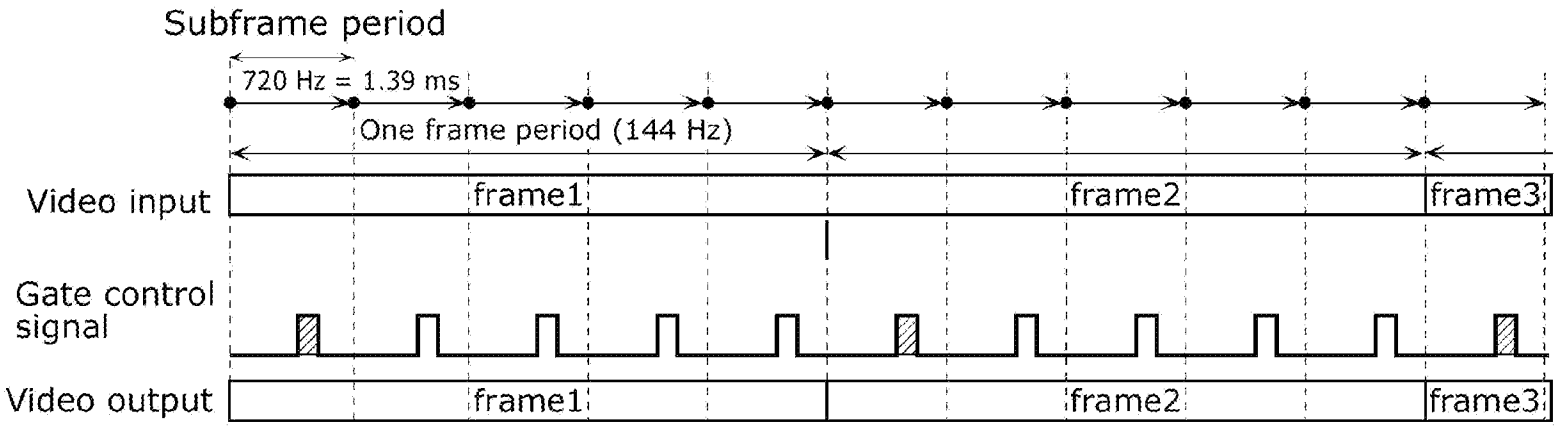
FIG. 5 is a diagram illustrating an overview of duty control performed by a duty controller according to the embodiment.

FIG. 5 is a diagram illustrating an overview of duty control performed by duty controller 50 according to the present embodiment.

Duty controller 50 detects a signal indicating the start of a frame period. The signal indicating the start of a frame period may be vertical synchronizing signal VS or may be video-period signal DE. Frame periods are assumed to be variable in the following description, but they may be fixed.

Duty controller 50 generates a gate control signal for causing gate driving circuit 14 to perform duty control as illustrated in FIG. 5. More specifically, when having detected the above signal, duty controller 50 generates a gate control signal for sequentially starting n subframe periods (n is an integer greater than or equal to 2) that configure the frame period, from the first subframe period, as the frame period, after a predetermined period of time has elapsed since the detection of the above signal. Based on this gate control signal, all of the subframe periods are made as periods of the same length determined in advance, and the ratios between the emission periods and the extinction periods in the subframe periods, i.e., duty ratios, are controlled to become the same ratio determined in advance.

Note that the subframe periods are not limited to the periods of the same length determined in advance, and may include periods of substantially the same length (which is not only limited to exactly the same length, but also includes lengths that are within a given error range and assumed to be the same). Similarly, the duty ratios are not limited to the same ratio determined in advance, and may be substantially the same ratio (which is not only limited to exactly the same ratio, but also includes ratios including certain errors and assumed to be the same ratio).

Duty controller 50 also generates a gate control signal for performing control so as to include an initialization period for initializing pixel circuits 30 in the extinction period of the first one of the n subframe periods.

In the case where the signal indicating the start of the next frame period after the frame period has been detected during execution of the last subframe period of the n subframe periods, the above predetermined period of time is a period from the time when the above signal has been detected during the last subframe to the time when the last subframe period ends.

To describe this using the example illustrated in FIG. 5, duty controller 50 generates a gate control signal for configuring each one frame period by a plurality of subframe periods of the same length and setting the same duty ratio for each subframe period so that the extinction periods in these subframe periods are of the same length. Note that duty controller 50 generates a gate control signal for causing the initialization period to be included in the extinction period of the first subframe period of one frame period. FIG. 5 shows a case in which one frame period is 144 Hz, one subframe period is 720 Hz (1.39 ms), and one frame period includes five subframe periods. In FIG. 5, the ON-state periods of the gate control signal correspond to the extinction periods, and each hatched ON-state period corresponds to the extinction period that includes the initialization period.

Next, a detailed configuration of duty controller 50 according to the present embodiment will be described.

Figure 6:
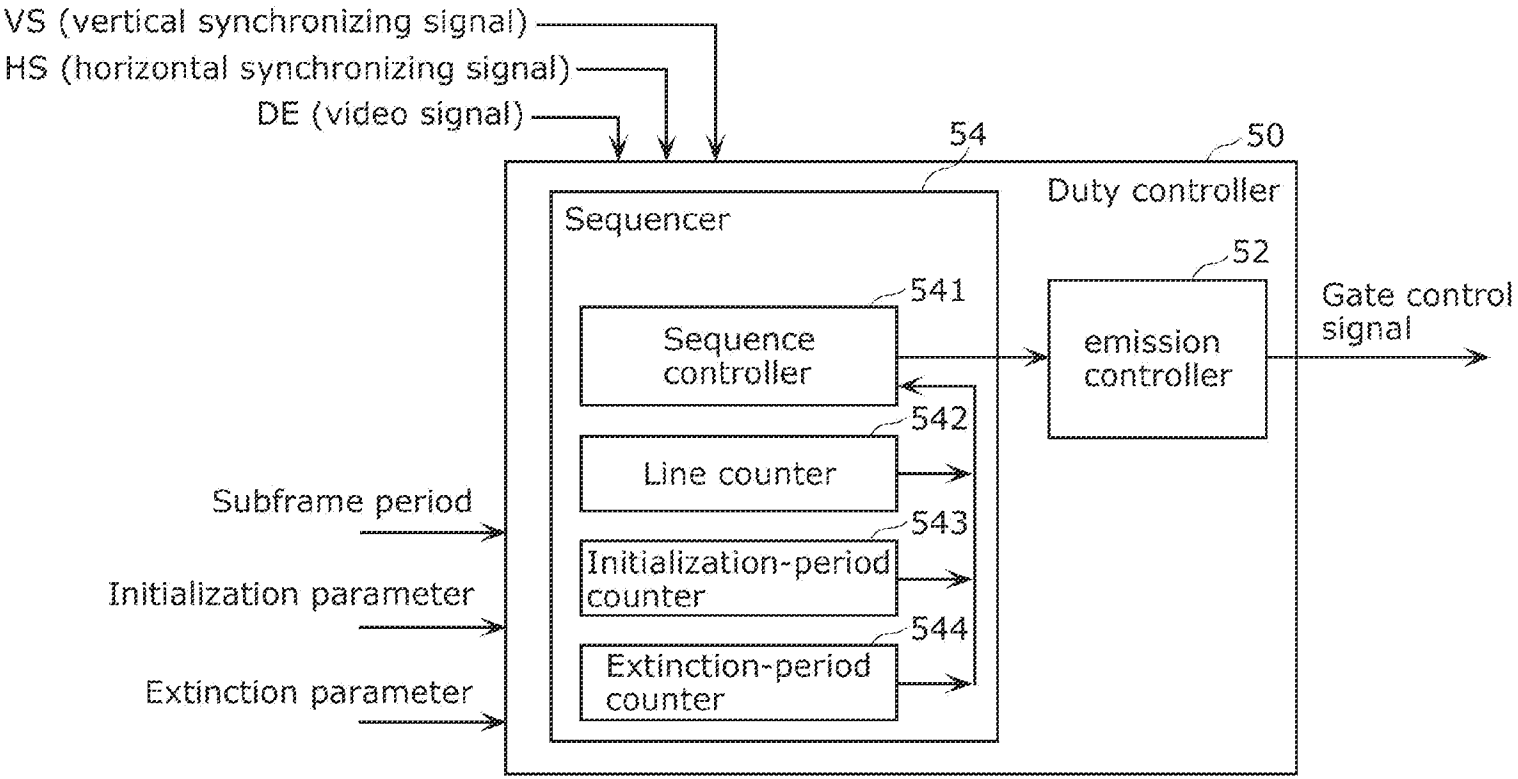
FIG. 6 is a block diagram illustrating a detailed configuration of the duty controller according to the embodiment.

FIG. 6 is a block diagram illustrating the detailed configuration of duty controller 50 according to the present embodiment.

In the present embodiment, duty controller 50 includes emission controller 52 and sequencer 54 as illustrated in FIG. 6, for example.

Sequencer 54 sets each subframe period to a period of a predetermined length, sets the duty ratio for the subframe period to a predetermined ratio, and outputs a sequence indicating continuous execution of subframe periods to emission controller 52. When having detected a signal indicating the start of a frame period, sequencer 54 includes, in the sequence, information indicating that the initialization period is included in the extinction period of the next subframe period after the subframe period being executed at the time of detection, and outputs the sequence to emission controller 52.

As illustrated in FIG. 6, sequencer 54 includes sequence controller 541, line counter 542, initialization-period counter 543, and extinction-period counter 544.

Sequence controller 541 generates a sequence for controlling display timing of video signals R, G, and B on the basis of vertical synchronizing signal VS, horizontal synchronizing signal HS, and video-period signal DE that are supplied from the outside.

In the present embodiment, sequence controller 541 detects a signal indicating the start of a frame period. Sequence controller 541 also acquires count values that are output from line counter 542, initialization-period counter 543, and extinction-period counter 544. Sequence controller 541 generates a sequence to be output to emission controller 52 on the basis of the length of input subframe periods, an initialization parameter, an extinction parameter, whether or not the signal has been detected, and the acquired count values.

Here, the length of subframe periods are set and fixed in advance by a user, for example. Each subframe period is, for example, 720 Hz (1.39 ms), but is not limited thereto. The extinction parameter indicates the extinction periods of the subframe periods and start timing of the extinction operation, is set in advance by a use, for example, and is fixed during the subframe periods. The initialization parameter indicates the initialization periods of the subframe periods and start timing of the initialization operation, is set in advance by a user, for example, and fixed during the subframe periods. Whether or not the signal has been detected refers to whether or not vertical synchronizing signal VS or video-period signal DE has been detected.

Then, sequence controller 541 generates a sequence indicating start timing of continuous subframe periods and start and end timing of the extinction and initialization operations in the subframe periods from the count values that are output from line counter 542 and other counters, and outputs the sequence to emission controller 52.

Line counter 542 is, for example, a timer and counts independently for each line. Line counter 542 outputs a count value obtained by the counting to sequence controller 541. From the count value output from line counter 542, sequence controller 54 knows the count value indicating, for example, the start and end times of the subframe periods.

Initialization-period counter 543 is, for example, a timer. Initialization-period counter 543 counts from the start time to end time of the extinction period that includes the initialization period of the subframe period. At the same time as the start of the counting, initialization-period counter 543 outputs the count value to sequence controller 541. At the end time of the subframe period, initialization-period counter 543 is reset to zero. From the count value output from initialization-period counter 543, sequence controller 541 knows the count value indicating, for example, the start and end times of the extinction periods of the subframe periods and the start and end times of the initialization period.

Extinction-period counter 544 is, for example, a timer. Extinction-period counter 544 counts from the start time to end time of the extinction period of each subframe period. At the same time as the start of the counting, extinction-period counter 544 outputs the count value to sequence controller 541. At the end time of the subframe period, extinction-period counter 544 is reset to zero. From the count value output from extinction-period counter 544, sequence controller 541 knows the count value indicating the start and end times of the extinction periods of the subframe periods.

Emission controller 52 generates gate control signals for controlling emission and extinction of light-emitting device 32 in accordance with the sequence input from sequencer 54 and outputs the gate control signals to gate driving circuit 14.

In the present embodiment, emission controller 52 generates control signals WS, REF, and INI and extinction signal EN as the gate control signals in accordance with the sequence input from sequencer 54 and supplies these gate control signals to gate driving circuit 14. For example, emission controller 52 generates the gate control signals as illustrated in the timing chart in FIG. 3A or FIG. 3B. In this case, time t01 in FIG. 3A corresponds to the start time of the first subframe period of the frame period. Time t11 in FIG. 3B corresponds to the start time of the subframe periods.

[6. Operations of Control Device]

Next, operations of control device 20 according to the present embodiment will be described.

Figure 7:
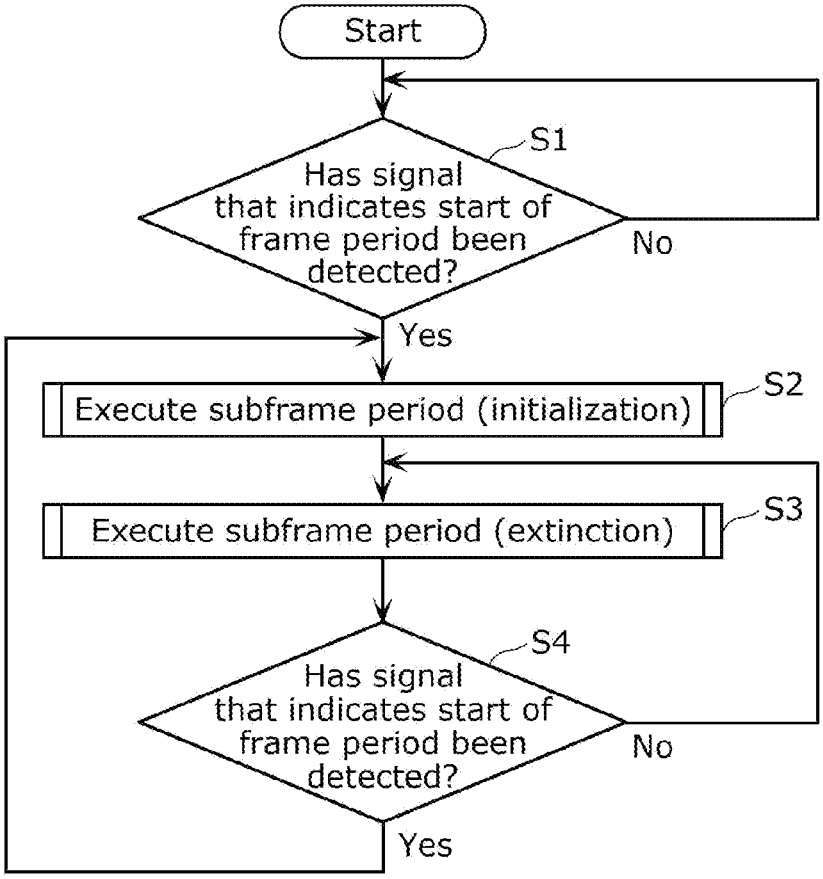
FIG. 7 is a flowchart illustrating an overview of an operation of controlling an emission period and an extinction period of a frame period, performed by the control device according to the embodiment.

FIG. 7 is a flowchart illustrating an overview of an operation of controlling the emission period and the extinction period of a frame period, performed by control device 20, according to the present embodiment.

As illustrated in FIG. 7, control device 20 checks all the time whether a signal indicating the start of a frame period has been detected (S1). The signal indicating the start of a frame period is vertical synchronizing signal VS or video-period signal DE as described above.

When the signal indicating the start of a frame period has been detected in step S1 (Yes in S1), control device 20 executes a subframe period that includes an initialization period in its extinction period (initialization) after a predetermined period of time has elapsed since the detection of the signal (S2). In the frame period, this subframe period (initialization) is the first one of a plurality of subframe periods that configure the frame period.

Next, control device 20 subframe periods (extinction) (S3). In the frame period, these subframe periods (extinction) are those of the plurality of subframe periods that configure the frame period, excluding the first subframe period.

Next, if a signal indicating the start of another frame period has been detected during execution of the subframe periods (extinction) in step S3 (Yes in S4), control device 20 returns to step S2 and executes a subframe period (initialization) after completion of the subframe period (extinction) that is being executed, i.e., after a predetermined period of time. On the other hand, if a signal indicating the start of another frame period has not been detected during execution of the subframe periods (extinction) (No in S4), control device 20 returns to step S3 and executes another subframe period (extinction) after completion of the subframe period (extinction) that is being executed.

A detailed operation of executing the subframe period (initialization) and the subframe periods (extinction) will be described below.

Figure 8A:
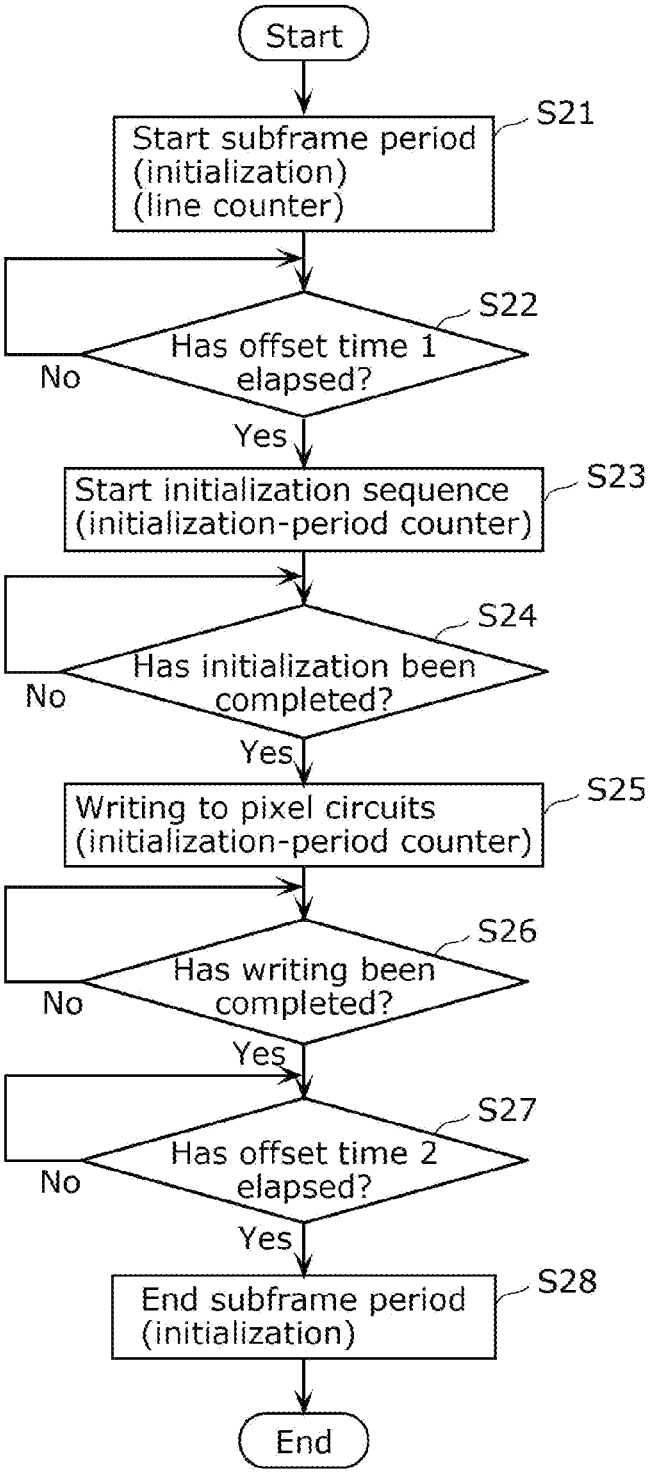
FIG. 8A is a flowchart illustrating a detailed operation performed in step S2 in FIG. 7.
Figure 8B:
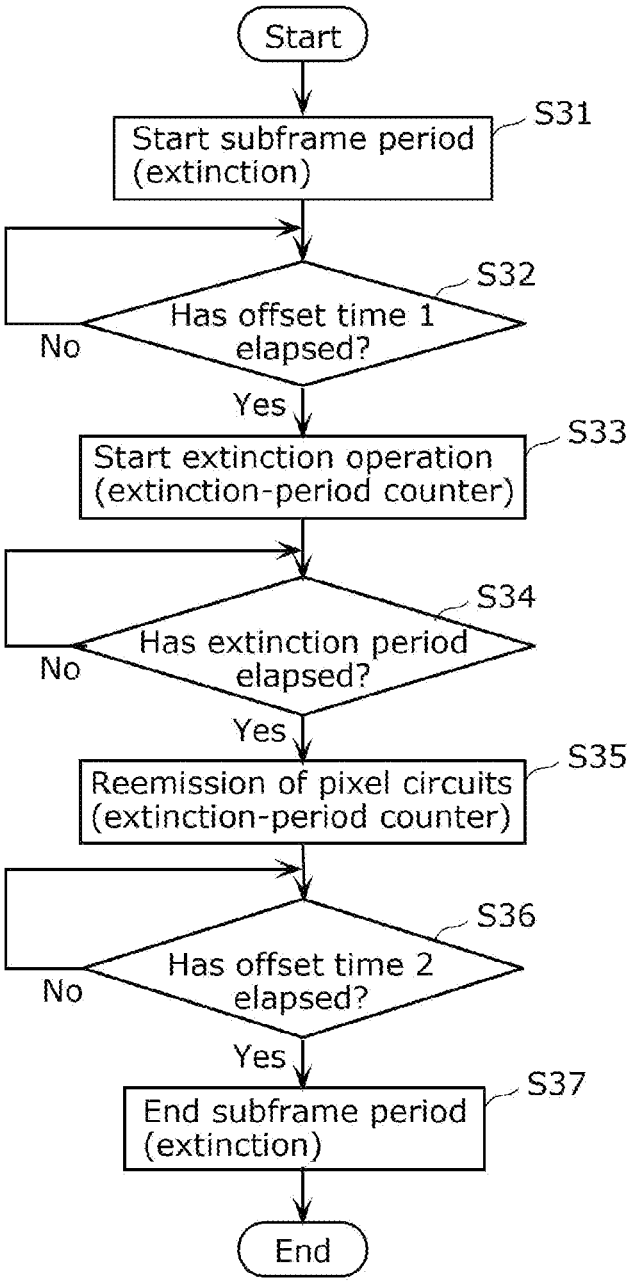
FIG. 8B is a flowchart illustrating a detailed operation performed in step S3 in FIG. 7.
Figure 9:
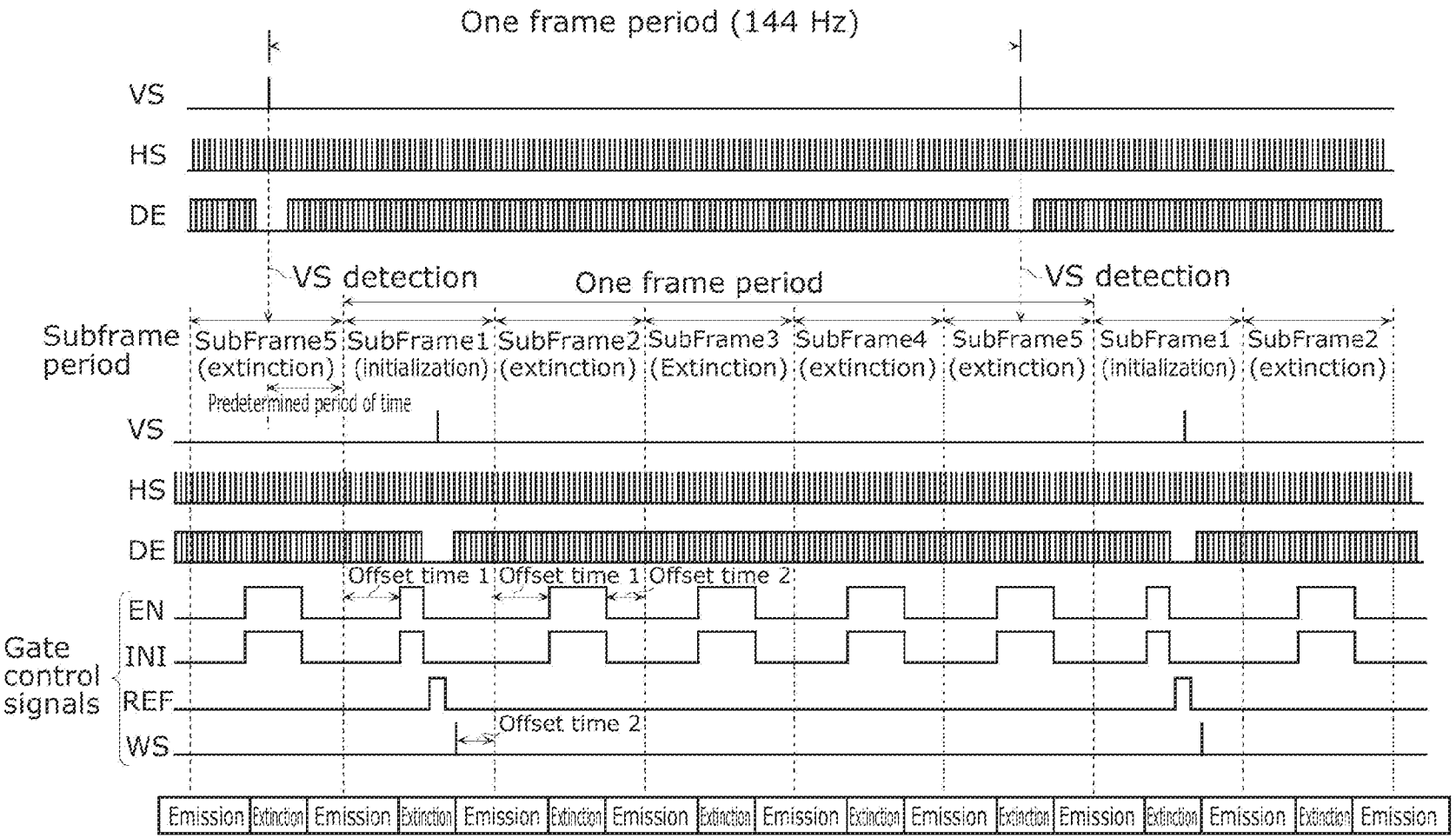
FIG. 9 is a diagram illustrating one example of a detailed operation of controlling the emission period and the extinction period of the frame period, performed by the control device, according to the embodiment.

FIG. 8A is a flowchart illustrating a detailed operation performed in step S2 illustrated in FIG. 7. FIG. 8B is a flowchart illustrating a detailed operation performed in step S3 illustrated in FIG. 7. FIG. 9 is a diagram illustrating one example of a detailed operation of controlling the emission period and the extinction period of a frame period, performed by control device 20, according to the present embodiment. FIG. 9 shows, as one example, a case in which one frame period is 144 Hz, one subframe period is 720 Hz (1.39 ms), and one frame period includes five subframe periods.

First, the detailed operation performed in step S2, illustrated in FIG. 8A, will be described. As illustrated in FIG. 8A, in step S2, control device 20 starts the subframe period (initialization) after a predetermined period of time has elapsed since the detection of the signal indicating the start of a frame period (S21). In the present embodiment, control device 20 uses the count value of line counter 542 to start the subframe period (initialization). In the example illustrated in FIG. 9, control device 20 starts SubFrame1 (initialization) after a predetermined period of time elapsed since the time of detection of vertical synchronizing signal VS. SubFrame1 (initialization) corresponds to the subframe period (initialization).

Next, control device 20 determines whether offset time 1 has elapsed since the start of the subframe period (initialization) (S22).

In step S22, if having determined from the count value of line counter 542 that offset time 1 has elapsed since the start of the subframe period (initialization) (Yes in S22), control device 20 starts an initialization sequence. If offset time 1 has not elapsed yet (No in S22), control device 20 waits for the lapse of offset time 1. In the present embodiment, control device 20 starts the initialization sequence, using the count value of initialization-period counter 543. In the example illustrated in FIG. 9, control device 20 starts the initialization sequence in SubFrame1 (initialization) by generating gate control signals for switching extinction signal EN and control signal INI to the high level after the lapse of offset time 1, and outputting the gate control signals to gate driving circuit 14. This causes light-emitting devices 32 of pixel circuits 30 in display panel 10 to become extinct. Note that extinction signal EN and control signals INI, REF, WS are the same as those described in FIG. 3A, and therefore descriptions thereof shall be omitted.

Next, control device 20 determines whether the initialization has been completed (S24). In the present embodiment, control device 20 uses the count value of initialization-period counter 543 to determine whether the initialization of pixel circuits 30 has been completed. In the example illustrated in FIG. 9, control device 20 determines the completion of the initialization by completing the initialization in accordance with the count value of initialization-period counter 543 in SubFrame1 (initialization). Note that control device 20 completes the initialization by generating gate control signals for, after the start of the initialization sequence, switching extinction signal EN and control signal INI to the low level, keeping control signal REF at the high level for a fixed period of time, and switching control signal REF to the low level, and outputting the gate controls signals to gate driving circuit 14.

In step S24, when having determined from the count value of initialization-period counter 543 that the initialization has been completed (Yes in S24), control device 20 starts writing to pixel circuits 30 (S25). In the present embodiment, control device 20 executes writing to pixel circuits 30, using the count value of initialization-period counter 543. In the example illustrated in FIG. 9, control device 20 generates, in SubFrame1 (initialization), gate control signals for switching control signal REF to the low level and then keeping control signal WS at the high level for a fixed period of time in accordance with the count value of initialization-period counter 543. Then, control device 20 starts writing by outputting the generated gate control signals to gate driving circuit 14.

Next, control device 20 determines whether the writing has been completed (S26). In the present embodiment, control device 20 determines whether the writing to pixel circuits 30 has been completed, using the count value of initialization-period counter 543. In the example illustrated in FIG. 9, control device 20 determines the completion of the writing by completing the writing to pixel circuits 30 in accordance with the count value of initialization-period counter 543 in SubFrame1 (initialization).

In step S26, when having determined from the count value of initialization-period counter 543 that the writing has been completed (Yes in S26), control device 20 determines whether offset time 2 has elapsed since the time of completion of the writing (S27).

In step S27, when having determined from the count value of line counter 542 that offset time 2 has elapsed since the time of completion of the writing (Yes in S27), control device 20 ends the subframe period (initialization) (S28). If offset time 2 has not elapsed yet (No in S27), control device 20 waits for the lapse of offset time 2. In the present embodiment, control device 20 ends the subframe period (initialization), using the count values of line counter 542 and initialization-period counter 543. In the example illustrated in FIG. 9, control device 20 ends SubFrame1 (initialization) when offset time 2 has elapsed since the time of completion of the writing.

Next, the detailed operation performed in step S3, illustrated in FIG. 8B, will be described. As illustrated in FIG. 8B, in step S3, control device 20 starts a subframe period (extinction) subsequent to the subframe period (initialization) or the previous subframe period (extinction) (S31). In the present embodiment, control device 20 starts the subframe period (extinction), using the count value of line counter 542. In the example illustrated in FIG. 9, control device 20 starts SubFrame2 (extinction) from the end time of SubFrame1 (initialization). Control device 20 also starts SubFrame3 (extinction) from the end time of SubFrame2 (extinction). The same applies to SubFrame4 (extinction) and SubFrame5 (extinction).

Then, control device 20 determines whether offset time 1 has elapsed since the start of the subframe period (extinction) (S32). Note that offset time 1 may be set to the same time as offset time 1 in step S22, or may be set to a different time.

In step S32, when having determined from the count value of line counter 542 that offset time 1 has elapsed since the start of the subframe period (extinction) (Yes in S32), the extinction operation is started (S33). If offset time 1 has not elapsed yet (No in S32), control device 20 waits for the lapse of offset time 1. In the present embodiment, control device 20 starts the extinction operation of pixel circuits 30, using the count value of extinction-period counter 544. In the example illustrated in FIG. 9, control device 20 start the extinction operation (extinction period) by, for example, generating gate control signals for switching extinction signal EN and control signal INI to the high level after the lapse of offset time 1 and outputting the gate control signals to gate driving circuit 14 in SubFrame2 (extinction). This causes light-emitting devices 32 of pixel circuits 30 in display panel 10 to become extinct. Note that extinction signal EN and control signals INI, REF, and WS are the same as those described in FIG. 3B, and therefore detailed descriptions thereof shall be omitted.

Then, control device 20 determines whether the extinction period has elapsed (S34).

In step S34, when having determined from the count value of extinction-period counter 544 that the extinction period of pixel circuit 30 has been completed (Yes in S34), control device 20 causes light-emitting devices 32 of pixel circuits 30 to again emit light (S35).

In the present embodiment, control device 20 determines whether the extinction period has elapsed, using the count value of extinction-period counter 544. In the example illustrated in FIG. 9, control device 20 determines the completion of the extinction period by completing the extinction period of pixel circuits 30 in accordance with the count value of extinction-period counter 544 in SubFrame2 (extinction). Note that control device 20 completes the extinction period by, after the extinction period, generating gate control signals for switching extinction signal EN and control signal INI to the low level, and then outputting the gate driving signals to gate driving circuit 14. Accordingly, control device 20 can cause light-emitting devices 32 of pixel circuits 30 to emit light again. In the example illustrated in FIG. 9, in SubFrame2 (extinction), control device 20 generates gate control signals for switching extinction signal EN and control signal INI to the low level in accordance with the count value of extinction-period counter 544 and outputs the gate driving signals to gate driving circuit 14. In this way, control device 20 can complete the extinction period and cause light-emitting devices 32 of pixel circuits 30 to emit light again in SubFrame2 (extinction).

Next, control device 20 determines whether offset time 2 has elapsed since the lapse of the extinction period (S36).

In step S36, when having determined from the count value of line counter 542 that offset time 2 has elapsed after the lapse of the extinction period (Yes in S36), control device 2 ends the subframe period (extinction) (S37). If offset time 2 has not elapsed yet (No in S36), control device 20 waits for the lapse of offset time 2. In the present embodiment, control device 20 ends the subframe period (extinction), using the count values of line counter 542 and extinction-period counter 544. In the example illustrated in FIG. 9, control device 20 ends SubFrame2 (extinction) after offset time 2 has elapsed since the end time of the extinction period.

Although vertical synchronizing signal VS is used as an example of the signal indicating the start of a frame period in FIG. 9 described above, the present disclosure is not limited thereto. The signal may be video-period signal DE. Hereinafter, the relationship between the signal indicating the start of a frame period and one frame period will be described.

Figure 10:
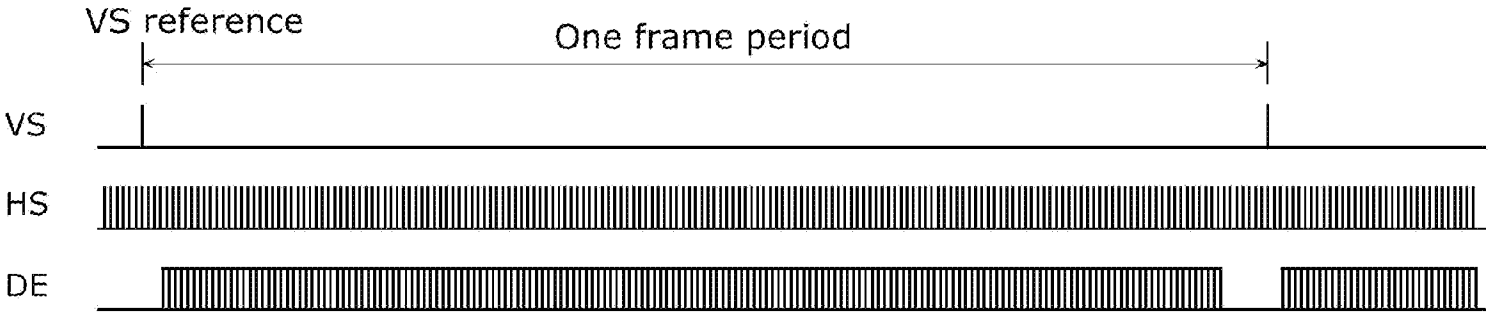
FIG. 10 is a diagram illustrating a case in which one frame period is started using detection of a vertical synchronizing signal as a reference, according to the embodiment.
Figure 11:
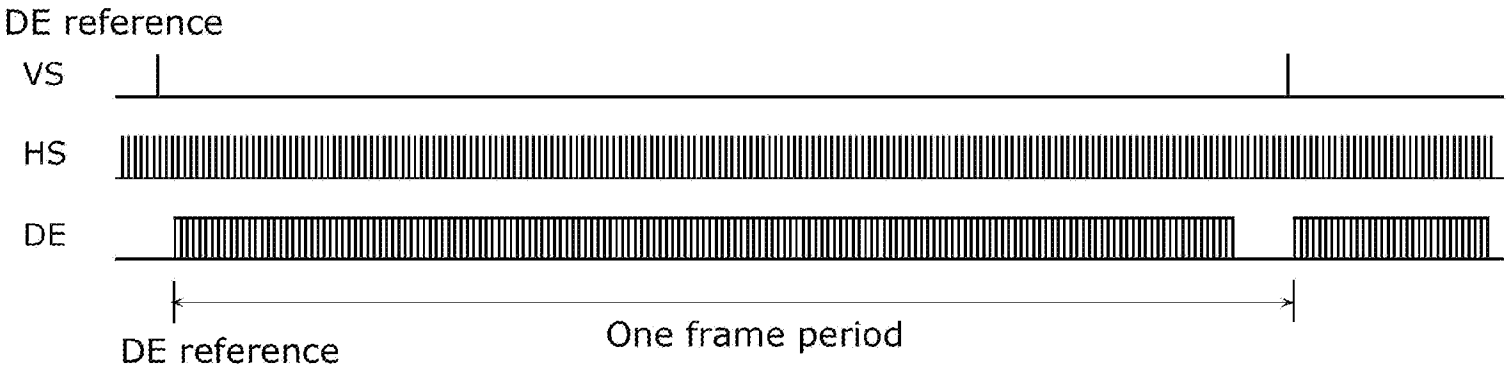
FIG. 11 is a diagram illustrating a case in which one frame period is started using detection of a video-period signal as a reference, according to the embodiment.

FIG. 10 is a diagram illustrating a case in which the detection of vertical synchronizing signal VS is used as a reference to start one frame period, according to the present embodiment. FIG. 11 is a diagram illustrating a case in which the detection of video-period signal DE is used as a reference to start one frame period, according to the present embodiment. That is, in the case of detecting vertical synchronizing signal VS as the signal indicating the start of a frame period, the frame period may be started in response to the detection of vertical synchronizing signal VS. In the present embodiment, when vertical synchronizing signal VS has been detected, the first subframe period of the frame period indicated by vertical synchronizing signal VS may be started after a predetermined period of time has elapsed since the time of detection of vertical synchronizing signal VS (after the end of the subframe period being executed at the time of detection).

On the other hand, in the case of detecting video-period signal DE as the signal indicating the start of a frame period, the frame period may be started in response to the detection of video-period signal DE. In the present embodiment, when video-period signal DE has been detected, the first subframe period of the frame period indicated by video-period signal DE may be started after a predetermined period of time (after the end of the current subframe period) has elapsed since the time of detection of video-period signal DE (after the end of the subframe period that is being executed at the time of detection).

Example 1

While the above description is given using, as an example, a case where one frame period is 144 Hz, one subframe period is 720 Hz (1.39 ms), and one frame period includes five subframe periods, the present disclosure is not limited to this case. The following description is given of the number of subframe periods in the case where frame periods vary in length.

Figure 12:
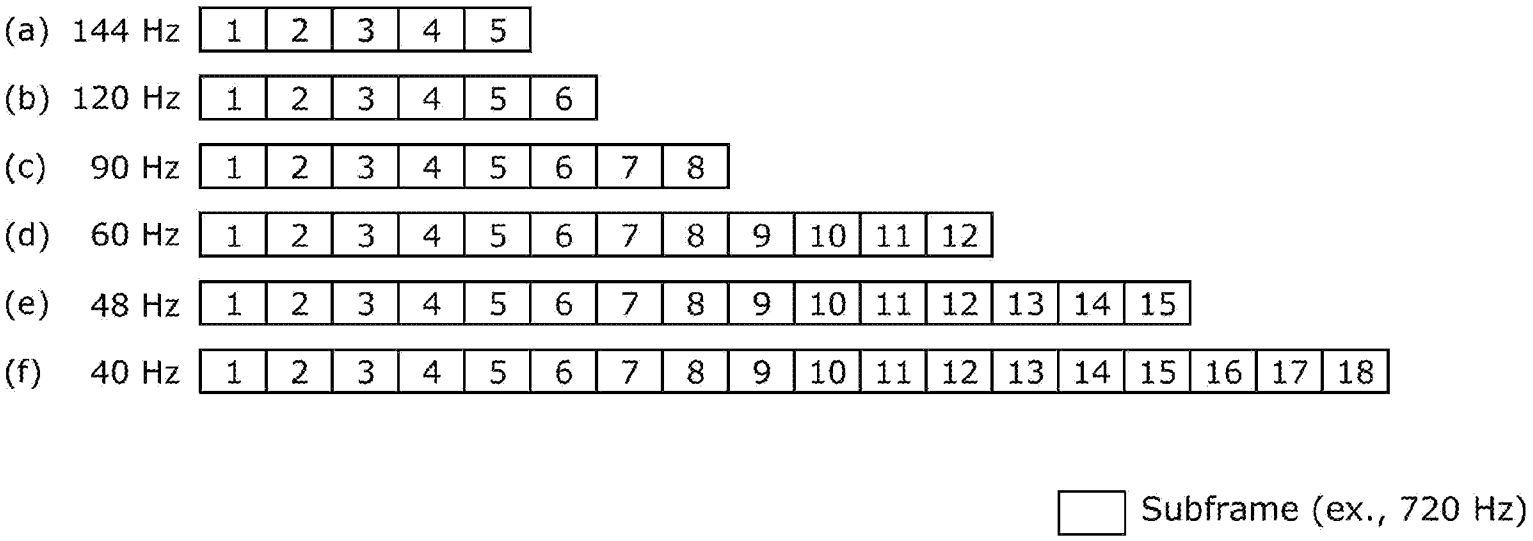
FIG. 12 is a diagram illustrating the number of subframe periods when frame periods vary in length according to the embodiment.

FIG. 12 is a diagram illustrating the numbers of subframe periods when frame periods vary in length, according to the embodiment. In FIG. 12, frame periods are expressed in terms of frame rate, and each subframe period is assumed to be 720 Hz (1.39 ms).

In the case where one frame period is 144 Hz as illustrated in (a) of FIG. 12, the frame period includes five subframe periods. Similarly, in the case where one frame period is 120 Hz as illustrated in (b) of FIG. 12, the frame period includes six subframe periods. In the case where one frame period is 90 Hz as illustrated in (c) of FIG. 12, the frame period includes eight subframe periods. In the case where one frame period is 60 Hz as illustrated in (d) of FIG. 12, the frame period includes 12 subframe periods. In the case where one frame period is 48 Hz as illustrated in (e) of FIG. 12, the frame period includes 15 subframe periods. In the case where one frame period is 40 Hz as illustrated in (f) of FIG. 12, the frame period includes 18 subframe period.

Next, the subframe periods illustrated in (a) to (f) of FIG. 12 will be described in detail with reference to FIGS. 13 to 18. FIGS. 13 to 18 are diagrams illustrating examples of a detailed operation of controlling the emission period and the extinction period of a frame period, performed by control device 20 when frame periods vary in length, according to the present embodiment. A description of part of the operation similar to that in FIG. 9 shall be omitted.

Figure 13:
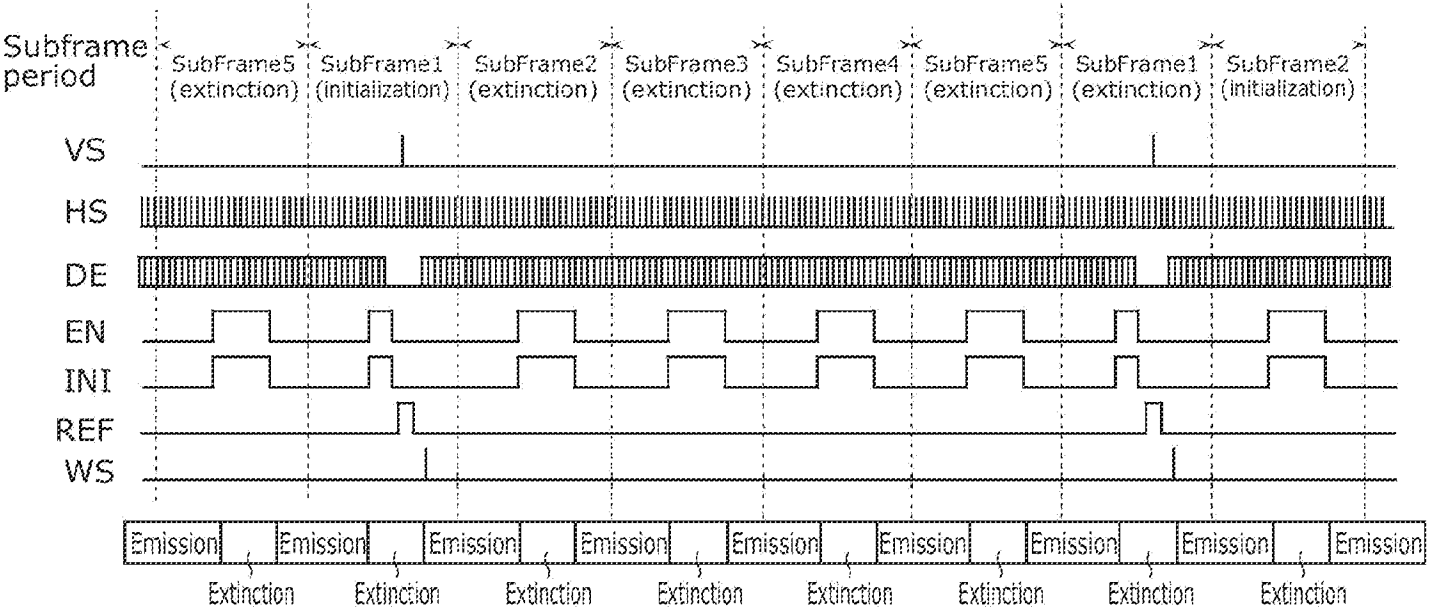
FIG. 13 is a diagram illustrating one example of a detailed operation of controlling the emission period and the extinction period of a frame period, performed by the control device when frame periods vary in length, according to the embodiment.

In FIG. 13, the subframe periods of the frame period of 144 Hz are illustrated. As illustrated in FIG. 13, when one frame period is 144 Hz, the frame period includes five subframe periods including SubFrame1 (initialization) and SubFrame2 (extinction) to SubFrame5 (extinction).

Figure 14:
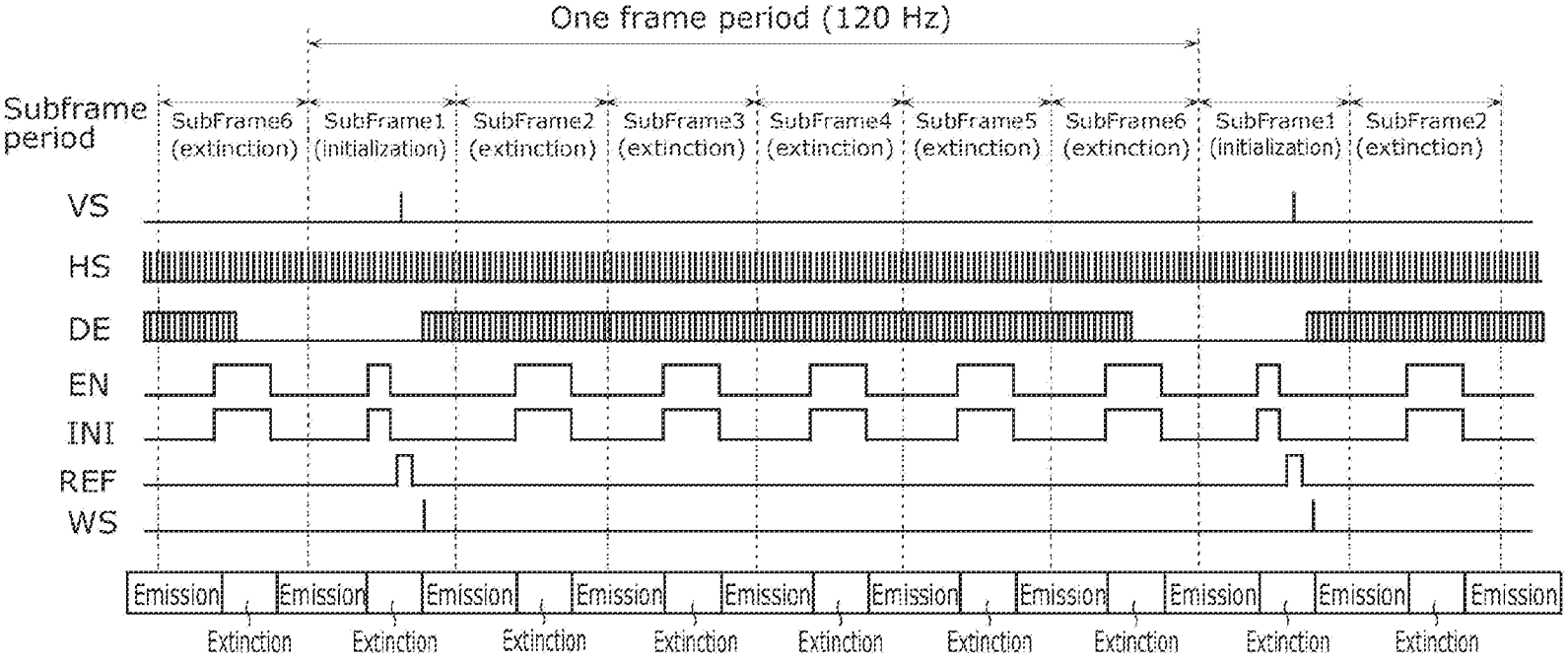
FIG. 14 is a diagram illustrating one example of a detailed operation of controlling the emission period and the extinction period of a frame period, performed by the control device when frame periods vary in length, according to the embodiment.

In FIG. 14, the subframe periods of the frame period of 120 Hz are illustrated. As illustrated in FIG. 14, when one frame period is 120 Hz, the frame period includes six subframe periods including SubFrame1 (initialization) and SubFrame2 (extinction) to SubFrame6 (extinction).

Figure 15:
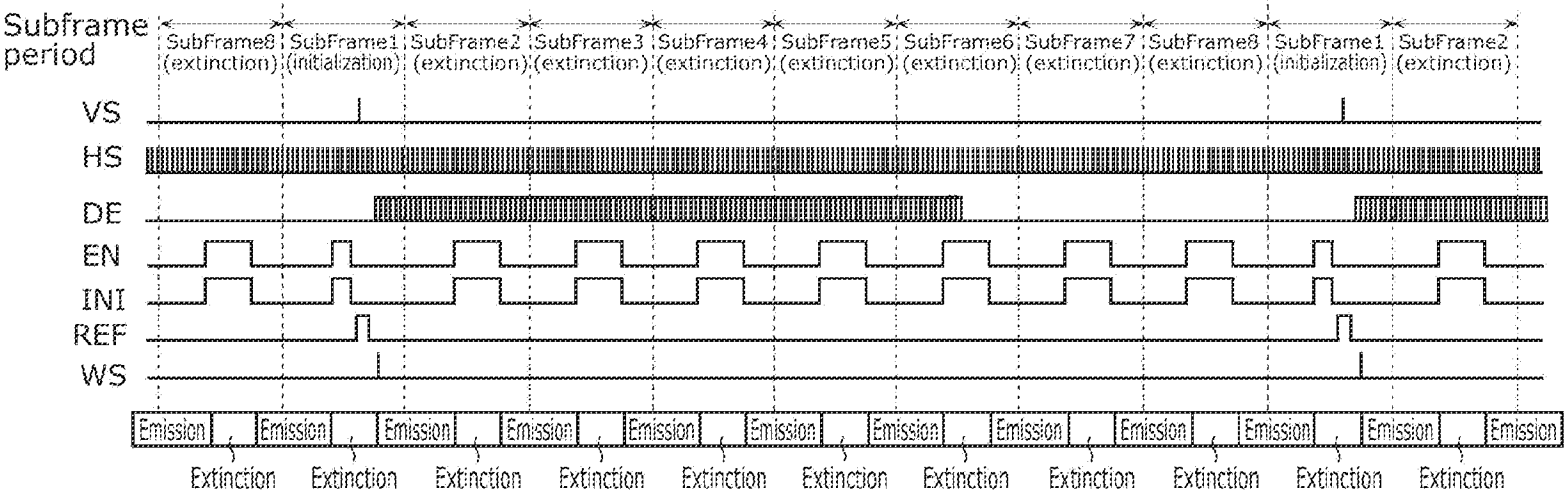
FIG. 15 is a diagram illustrating one example of a detailed operation of controlling the emission period and the extinction period of a frame period, performed by the control device when frame periods vary in length, according to the embodiment.

In FIG. 15, the subframe periods of the frame period of 90 Hz are illustrated. As illustrated in FIG. 15, when one frame period is 90 Hz, the frame period includes eight subframe periods including SubFrame1 (initialization) and SubFrame2 (extinction) to SubFrame8 (extinction).

Figure 16:
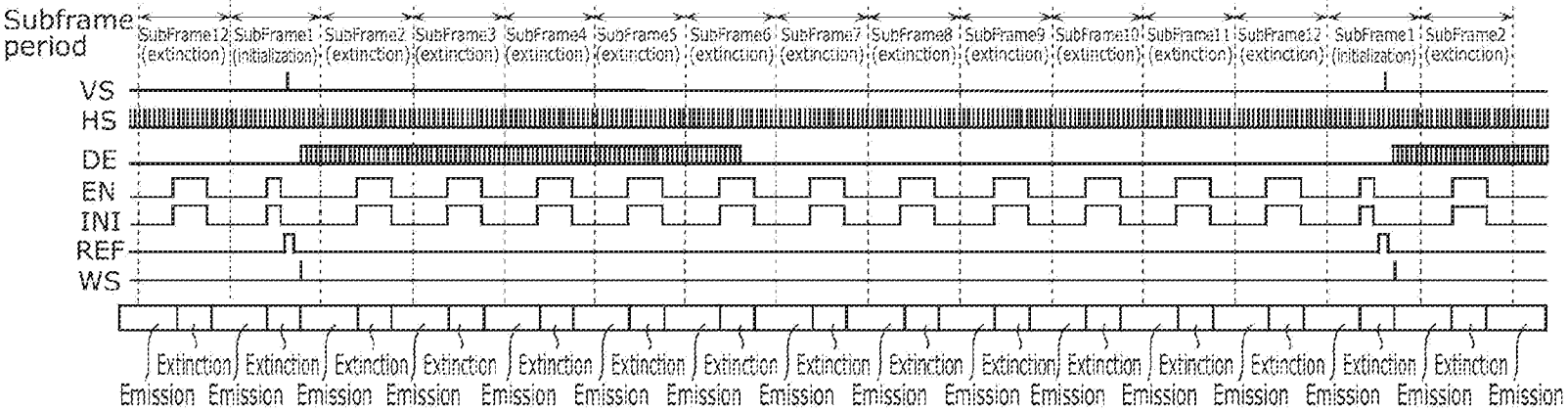
FIG. 16 is a diagram illustrating one example of a detailed operation of controlling the emission period and the extinction period of a frame period, performed by the control device when frame periods vary in length, according to the embodiment.

In FIG. 16, the subframe periods of the frame period of 60 Hz are illustrated. As illustrated in FIG. 16, when one frame period is 60 Hz, the frame period includes 12 subframe periods including SubFrame1 (initialization) and SubFrame2 (extinction) to SubFrame12 (extinction).

Figure 17:
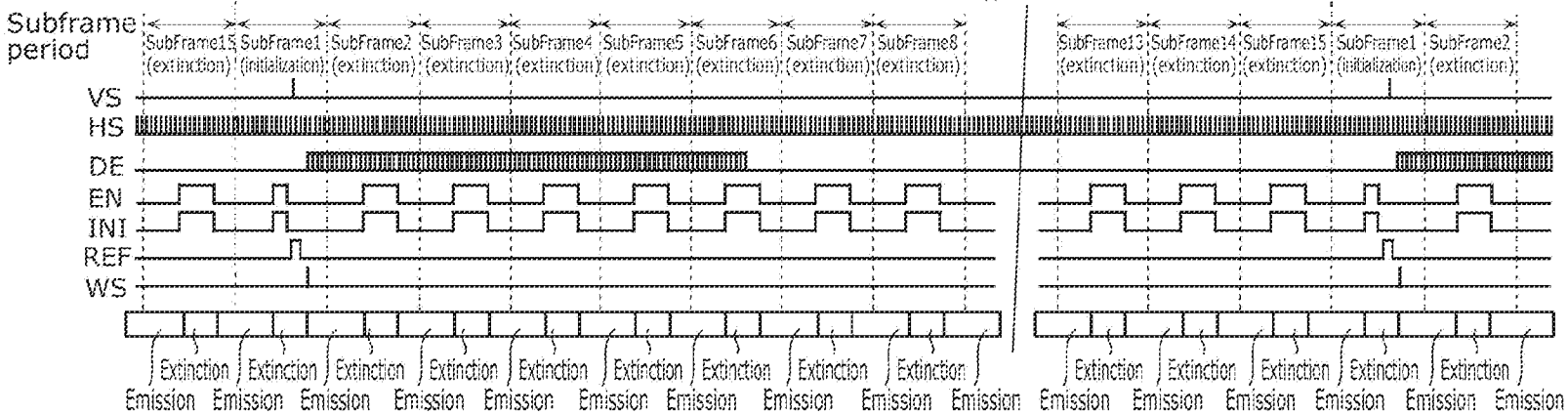
FIG. 17 is a diagram illustrating one example of a detailed operation of controlling the emission period and the extinction period of a frame period, performed by the control device when frame periods vary in length, according to the embodiment.

In FIG. 17, the subframe periods of the frame period of 48 Hz are illustrated. As illustrated in FIG. 17, when one frame period is 48 Hz, the frame period includes 15 subframe periods including SubFrame1 (initialization) and SubFrame2 (extinction) to SubFrame15 (extinction).

Figure 18:
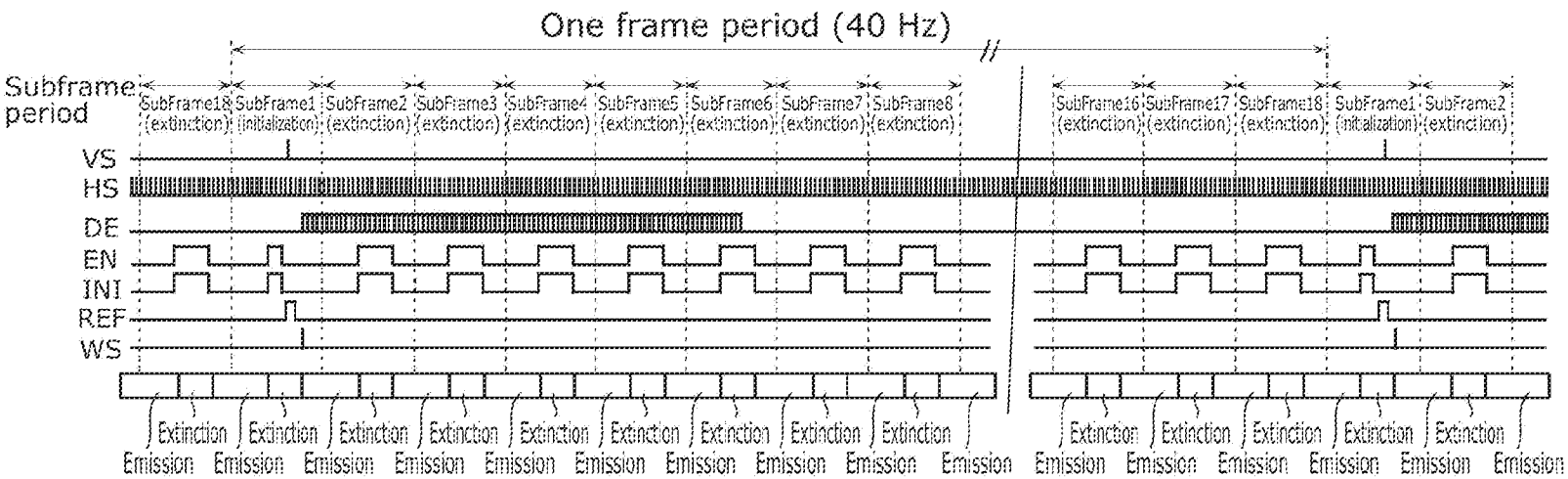
FIG. 18 is a diagram illustrating one example of a detailed operation of controlling the emission period and the extinction period of a frame period, performed by the control device when frame periods vary in length, according to the embodiment.

In FIG. 18, the subframe periods of the frame period of 40 Hz are illustrated. As illustrated in FIG. 18, when one frame period is 40 Hz, the frame period includes 18 subframe periods including SubFrame1 (initialization) and SubFrame2 (extinction) to SubFrame18 (extinction).

Example 2

While Example 1 has been described using, as examples, the cases where one frame period having a varying length can be divided by subframe periods without a remainder, i.e., one frame period is an integral multiple of subframe periods, the present disclosure is not limited to these examples. That is, frame periods do not necessarily have to integral multiples of subframe periods.

Hereinafter, one example of this case will be described as Example 2.

Figure 19:
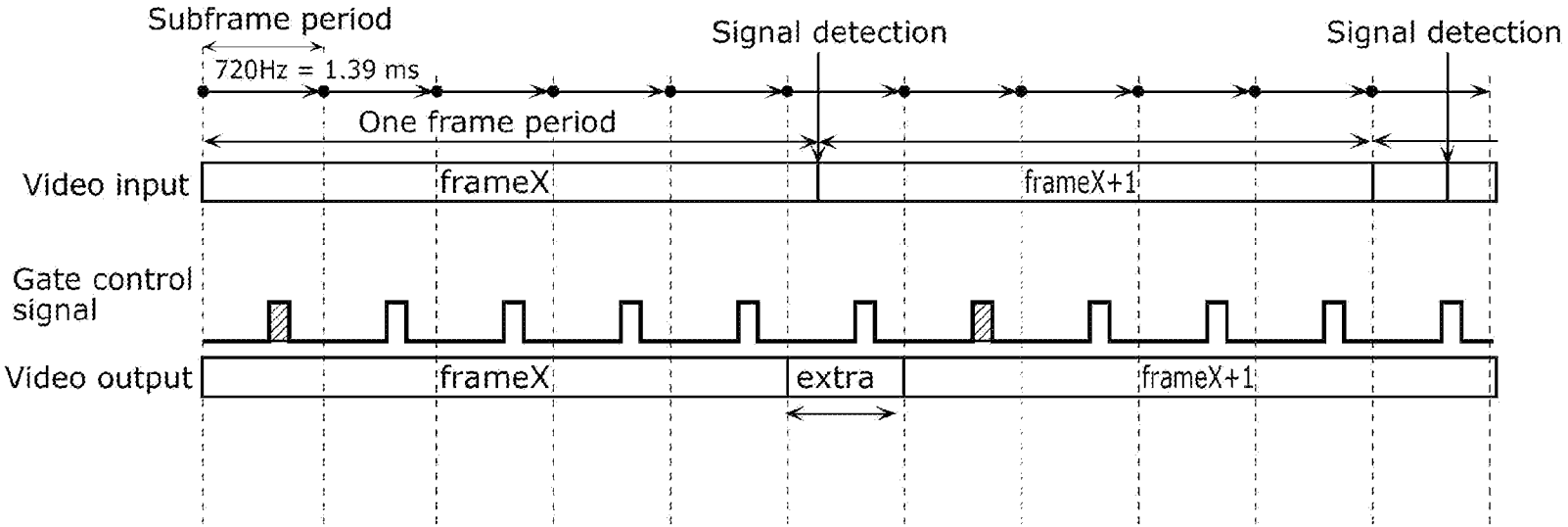
FIG. 19 is a diagram illustrating an overview of duty control performed by a duty controller according to Example 2 of the embodiment.

FIG. 19 is a diagram illustrating an overview of duty control performed by duty controller 50 according to Example 2 of the present embodiment. FIG. 19 shows an example of the case in which one subframe period is 720 Hz (1.39 ms), but the frame rate of one frame period is lower than 144 Hz and higher than 120 Hz. In the example illustrated in FIG. 19, a signal indicating the start of a frame period, such as vertical synchronizing signal VS, has not been detected until the end of the five subframe periods of the X-th frame period, i.e., FrameX. In this case, control device 20 further executes another subframe period ("extra" in the drawing) after the end of the last subframe period, i.e., the fifth subframe period.

Figure 20:
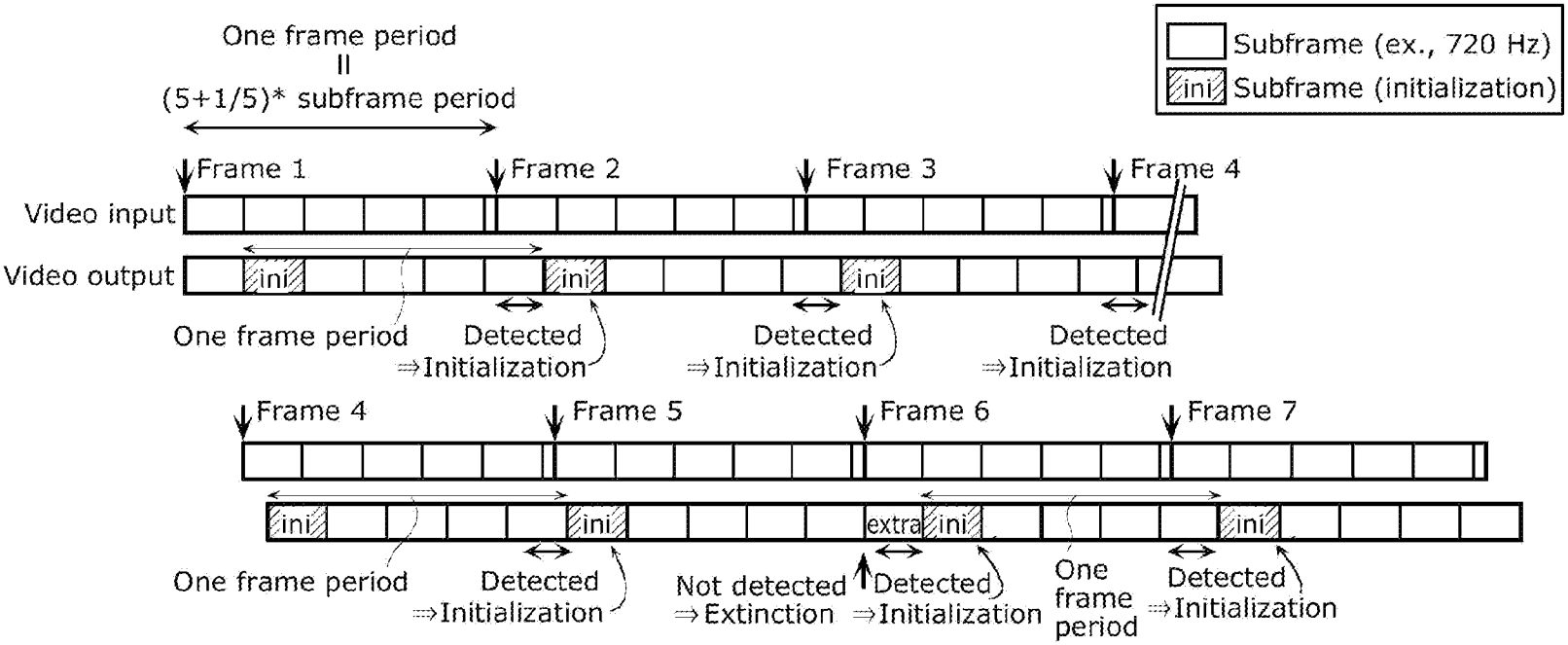
FIG. 20 is a diagram illustrating a specific example of the duty control performed by the duty controller according to Example 2 of the embodiment.

FIG. 20 is a diagram illustrating a specific example of duty control performed by duty controller 50 according to Example 2 of the present embodiment. In the example illustrated in FIG. 20, a case is illustrated in which one subframe period is 720 Hz (1.39 ms), and one frame period includes (5+1/5) subframe periods.

In this case, once every five frame periods, one subframe period (extra) may be added after five subframe periods as duty control performed by duty controller 50. In other words, as illustrated in FIG. 20, every five frame periods, a signal indicating the start of a frame period is not detected during execution of the last (fifth) subframe period. In this case, one subframe period ("extra" in the drawing) may be further executed after the end of the last (fifth) subframe of the fifth frame period.

More specifically, when having detected a signal indicating the start of a frame period, duty controller 50 sequentially starts n subframe periods (n is an integer greater than or equal to 2) that configure the frame period, from the first subframe period, as the frame period, after a predetermined period of time has elapsed since the detection of the signal. Here, a case is assumed in which duty controller 50 does not detect a signal indicating the start of the next frame after the frame period, during execution of the last one of the n subframe periods. In this case, duty controller 50 determines that the frame period is not an integral multiple of subframe periods, and further starts an added subframe period that is executed after the end of the last subframe period. Note that the added subframe period and the n subframe periods are all controlled so as to have the same length determined in advance. Also, the added subframe period and the n subframe periods are controlled so as to have the same ratio between the emission period and the extinction period, determined in advance, the ratio being referred to as a duty ratio.

In this example as well, when having detected a signal indicating the start of a frame period, duty controller 50 generates gate control signals for including the initialization period in the extinction period of the next subframe period after the subframe period that is being executed at the time of the detection. In cases other than this, i.e., when having not detected a signal indicating the start of a frame period, duty controller 50 may generate gate control signals for repeatedly executing the subframe periods that include the emission periods and the extinction periods spaced at fixed intervals. With this control, even if the frame period is not an integral multiple of subframe periods, duty controller 50 can disperse the extinction period of the frame period into a plurality of subframe periods and can repeat the emission period and the extinction period at fixed intervals.

In the case where a signal indicating the start of the next frame period after the frame period has not been detected during execution of the last one of the n subframe periods, duty controller 50 does not necessarily have to determine that the frame period is not an integral multiple of subframe periods. At this time, duty controller 50 may determine that the frame period has not ended yet. Specifically, a case is assumed in which duty controller 50 does not detect a signal indicating the start of the next frame period after the frame period during execution of the last one of the n subframe periods. In this case, duty controller 50 may determine that the frame period has not ended yet and may further start another subframe period that is executed after the end of the last subframe period. Moreover, if the start of the next frame period has not been detected until the end time of the added subframe period, duty controller 50 may repeatedly execute the added subframe period until detection of the start of the next frame period.

[7. Advantageous Effects]

First, a comparative example will be described.

Figure 21A:
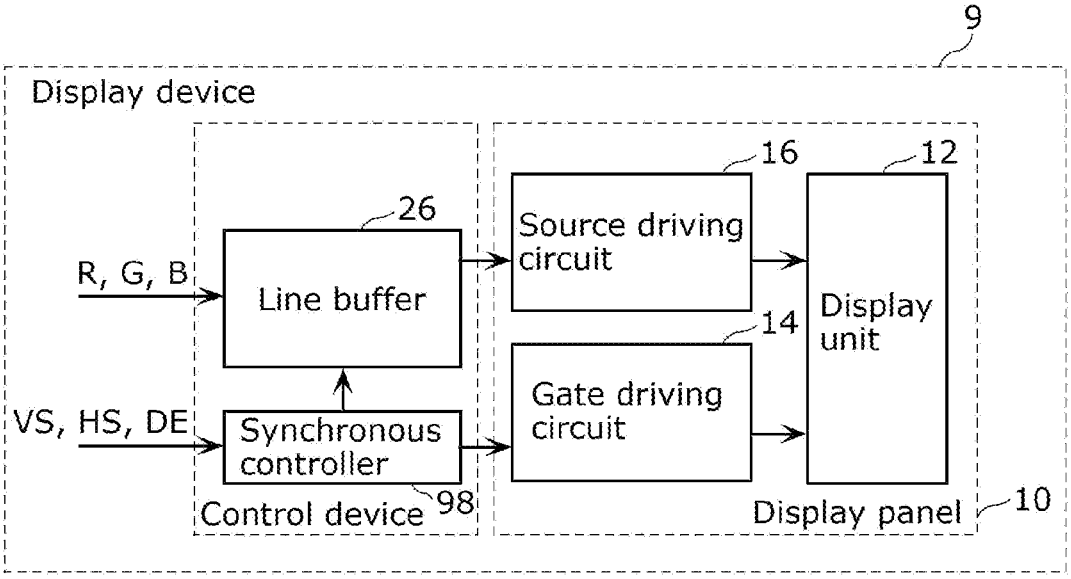
FIG. 21A is a schematic diagram illustrating a configuration example of a display device according to a comparative example.
Figure 21B:
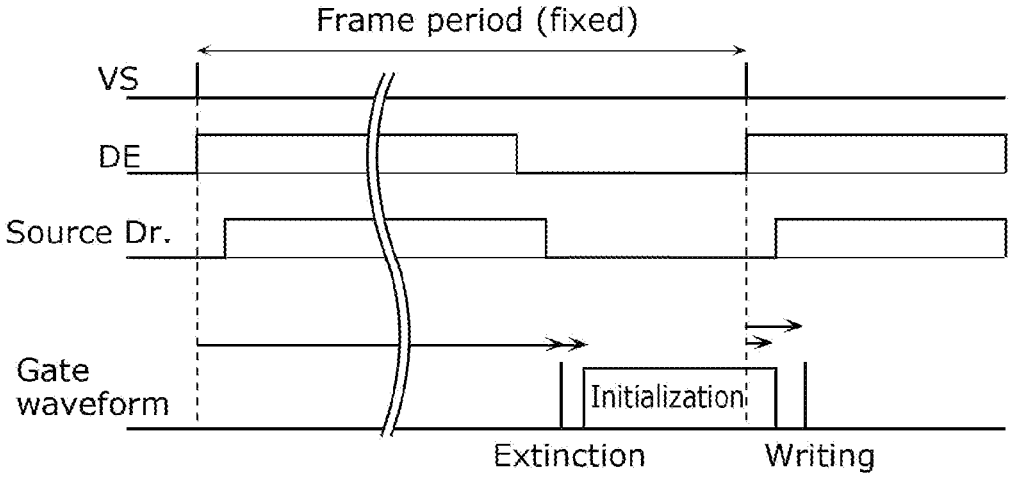
FIG. 21B is a diagram illustrating a gate waveform that a synchronous controller illustrated in FIG. 21A outputs to a gate driving circuit.

FIG. 21A is a schematic diagram illustrating a configuration example of display device 9 according to the comparative example. FIG. 21B is a diagram illustrating a gate waveform that synchronous controller 98 illustrated in FIG. 21A outputs to the gate driving circuit. Note that elements that are similar to those in FIG. 4 and other drawings are given the same reference signs, and detailed descriptions thereof shall be omitted.

As illustrated in FIG. 21A, display device 9 according to the comparative example includes display panel 10 and a control device that includes line buffer 26 and synchronous controller 98.

Synchronous controller 98 generates a waveform of a gate driver including an extinction operation, an initialization operation, and a writing operation as illustrated in FIG. 21B, using the input of vertical synchronizing signal VS as a starting point.

However, in the case of generating the waveform of the gate driver as illustrated in FIG. 21B, if one frame period varies in length, the period from the extinction operation to the writing period also varies, which makes flicker visible. Hereinafter, this problem will be described using an example.

Figure 22A:
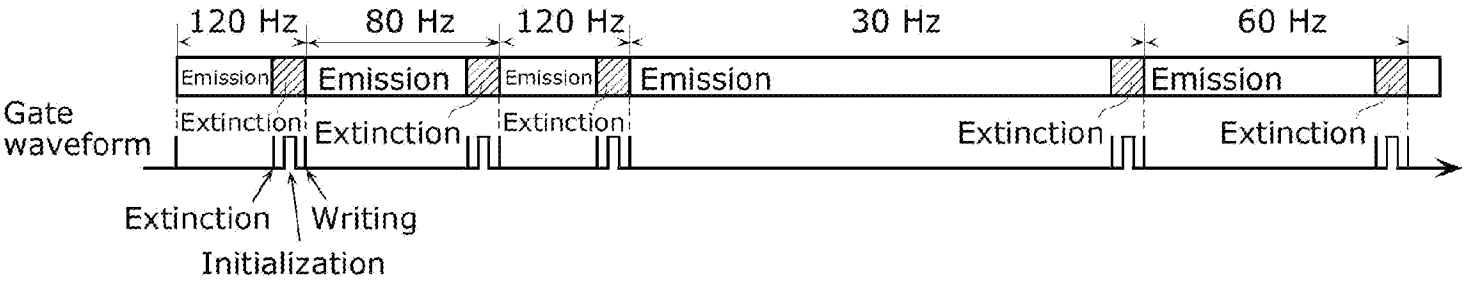
FIG. 22A is a diagram illustrating the emission period and the extinction period of each frame period in the case where the control device according to the comparative example makes the extinction period constant, irrespective of variations in the frame periods.
Figure 22B:
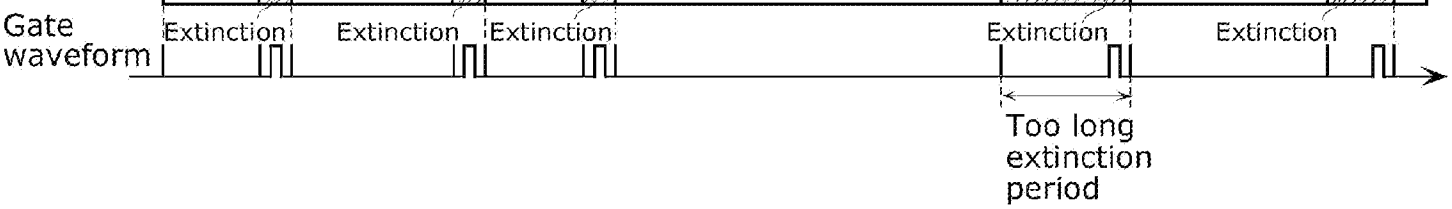
FIG. 22B is a diagram illustrating the emission period and the extinction period of each frame period in the case where the control device according to the comparative example changes the extinction period according to variations in the frame periods so as to make the duty ratio constant.

FIGS. 22A and 22B are diagrams for describing the problem of display device 9 according to the comparative example. FIG. 22A is a diagram illustrating the emission period and the extinction period of each frame period in the case where the control device according to the comparative example makes the extinction periods constant in length, irrespective of variations in the lengths of frame periods. That is, FIG. 22A shows an example of a case where the extinction periods have a constant length even if the number of vertical lines per frame rate, i.e., per frame period, varies.

As illustrated in FIG. 22A, in the case where the extinction periods have a constant length irrespective of variations in the lengths of frame periods, the emission periods become longer as the frame rates decrease, whereas the emission periods become shorter as the frame rates increase. Thus, the emission periods are not repeated at fixed intervals, and the brightness of the screen becomes inconstant. This causes screen flicker to be perceptible and visible.

FIG. 22B is a diagram illustrating the emission period and the extinction period of each frame period in the case where the control device according to the comparative example makes the duty ratios constant by changing the lengths of the extinction periods in accordance with variations in the lengths of frame periods. That is, FIG. 22B shows an example of a case where the duty ratios are made constant by changing the lengths of the extinction periods with a change in frame rate.

In the case where the duty ratios are made constant by changing the lengths of the extinction periods in accordance with variations in the lengths of frame periods as illustrated in FIG. 22B, not only the emission periods but also the extinction periods become longer as the frame rates decrease. This enables human eyes to readily recognize flashing and perceive screen flicker, thus making flicker visible. Moreover, in the case where the number of vertical lines is not known beforehand due to varying frame periods, a total emission period of one frame period is also not known. This arises a problem in that the degree to which off-duty periods are provided is not known.

In contrast, control device 20 according to the present embodiment can disperse the extinction period of one frame period by dividing the frame period into a plurality of subframe periods of a fixed length, and can repeat the emission period and the extinction period at fixed intervals. Even in the case where the number of vertical lines is not known beforehand, and besides, frame periods always or sometimes vary in length, on-duty and off-duty periods of a predetermined length can be repeated in a fixed cycle called a subframe period.

Accordingly, even if frame periods widely vary in length, flicker can be made invisible on the display panel for displaying an image. That is, it is possible to suppress a flicker phenomenon even if frame periods vary in length.

Moreover, if a signal indicating the start of the next frame period after the last subframe period of the frame period has been detected during execution of the last subframe period, control device 20 according to the present embodiment starts the first subframe period of the next frame period subsequently to the last subframe period. This makes it easy to follow variations in the lengths of frame periods and accordingly suppresses a flicker phenomenon even if frame periods vary in length Moreover, even if the frame period is not an integral multiple of subframe periods of a predetermined length, control device 20 according to the present embodiment can repeat the emission period and the extinction period at fixed intervals, using a plurality of subframe periods. This makes flicker invisible.

Moreover, control device 20 according to the present embodiment can provide a proper video display during a frame period by including the initialization period for initializing the pixel circuits in the extinction period that starts at the beginning of the frame period.

Note that control device 20 according to the present embodiment may be compliant with Adaptive-Sync. In other words, control device 20 according to the present embodiment may be compliant with standards that make the start timing of imaging variable in accordance with the processing time of a GPU, and may dynamically change the number of subframe periods that configure one frame period in accordance with an input video signal. More specifically, frame periods may be variable, and may be changed dynamically in compliance with Adaptive-Sync. Here, Adaptive-Sync is a technique for avoiding problems such as stuttering and tearing by imaging the screen in accordance with the end timing of frame processing of the GPU, and enables real-time adjustment of the refresh rate of the display device. With control device 20 compliant with Adaptive-Sync according to the present embodiment, if the frame rate does not reach the fastest frame rate of the display device, it is possible to maintain the frame rate as fast as possible by, for example, delaying the start timing of display to wait for the end of processing of the GPU and then starting imaging immediately after the end of the processing. Note that examples of known standards other than those defined as Adaptive-Sync standards include G-SYNC and FreeSync defined as authentication specifications by GPU vendors.

In this way, control device 20 according to the present embodiment may be compliant with authentication standards such as G-SYNC and FreeSync or with Adaptive-Sync standards, and in this case, it is possible to suppress the occurrence of flicker while following wide synchronous variations.

[Variation 1]

While the configuration of pixel circuits 30 according to the above embodiment has been described with reference to FIG. 2, the present disclosure is not limited to this example. Hereinafter, a configuration example different from that of pixel circuits 30 in FIG. 2 will be described as Variation 1.

Figure 23A:
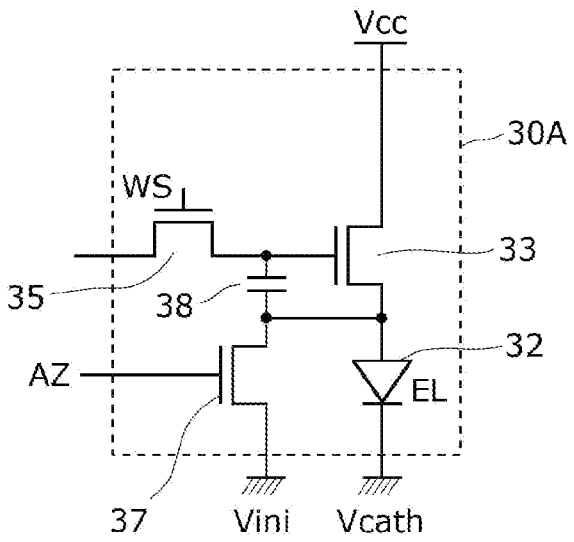
FIG. 23A is a circuit diagram schematically illustrating an example of the configuration of one pixel circuit according to Variation 1 of the embodiment.
Figure 23B:
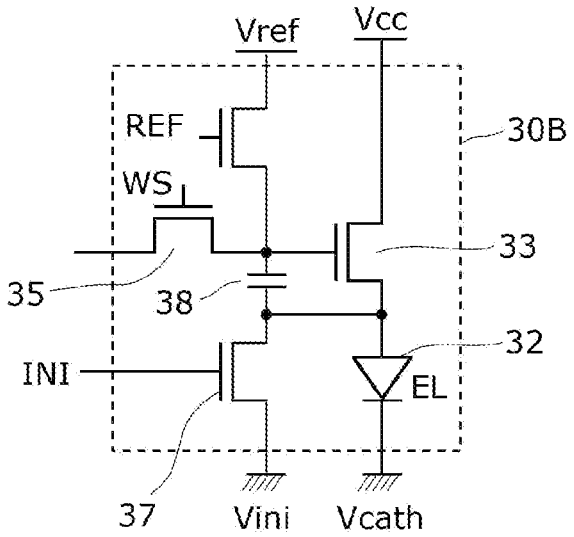
FIG. 23B is a circuit diagram schematically illustrating another example of the configuration of one pixel circuit according to Variation 1 of the embodiment.

FIG. 23A is a circuit diagram schematically illustrating a configuration example of pixel circuit 30A according to Variation 1 of the present embodiment. FIG. 23B is a circuit diagram schematically illustrating another configuration example of pixel circuit 30B according to Variation 1 of the present embodiment. Elements that are similar to those in FIG. 2 are given the same reference signs, and detailed descriptions thereof shall be omitted.

That is, pixel circuit 30 illustrated in FIG. 2 may be pixel circuit 30A illustrated in FIG. 23A, or may be pixel circuit 30B illustrated in FIG. 23B.

Pixel circuit 30A differs from pixel circuit 30 illustrated in FIG. 2 in that it does not include switch transistors 34 and 36.

Pixel circuit 30A does not include switch transistor 34 and therefore uses switch transistor 37 for emission or extinction of light-emitting device 32, i.e., the emission operation or the extinction operation of pixel circuit 30A. Pixel circuit 30A also does not include switch transistor 36 and therefore uses switch transistor 37 for the initialization operation.

More specifically, the extinction operation of pixel circuit 30A is conducted as follows. That is, when control signal AZ is applied from gate driving circuit 14 to the gate of switch transistor 37 and switch transistor 37 is turned on, the drain-source current of drive transistor 33 flows to switch transistor 37 and does not flow to light-emitting device 32. Accordingly, light-emitting device 32 becomes extinct. The emission operation of pixel circuit 30A is conducted as follows. That is, when the application of control signal AZ to the gate of switch transistor 37 is stopped and switch transistor 37 is turned off, the drain-source current of drive transistor 33 flows to light-emitting device 32. Accordingly, light-emitting device 32 emits light.

Pixel circuit 30B differs from pixel circuit 30 illustrated in FIG. 2 in that it does not include switch transistor 34. Pixel circuit 30B does not include switch transistor 34 and therefore uses switch transistor 37 for emission and extinction of light-emitting device 32, i.e., the emission operation and the extinction operation of pixel circuit 30A.

More specifically, the extinction operation of pixel circuit 30B is conducted as follows. That is, when control signal INI is applied from gate driving circuit 14 to the gate of switch transistor 37 and switch transistor 37 is turned on, the drain-source current of drive transistor 33 flows to switch transistor 37 and does not flow to light-emitting device 32. Accordingly, light-emitting device 32 becomes extinct. The emission operation of pixel circuit 30B is conducted as follows. That is, when the application of control signal INI to the gate of switch transistor 37 is stopped and switch transistor 37 is turned off, the drain-source current of drive transistor 33 flows to light-emitting device 32. Accordingly, light-emitting device 32 emits light.

Note that the configuration of the pixel circuits included in display device 1 is not limited to the aforementioned configuration. For example, the arrangement of the other switch transistors may be appropriately changed as long as the display device has a configuration including a drive transistor, a selector transistor, and a pixel capacitance. A plurality of transistors provided in the pixel circuits may be polysilicon TFTs, or may be configured as other transistors such as amorphous silicon TFTs. The conductivity types of the transistors may be the n type or the p-type, or may be a combination of the n type and the p type.

[Variation 2]

While in the description of the above embodiment, each pixel circuit included in display device 1 includes an organic EL device as a light-emitting device, the present disclosure is not limited to this example. The pixel circuits may include liquid crystals.

Figure 24:
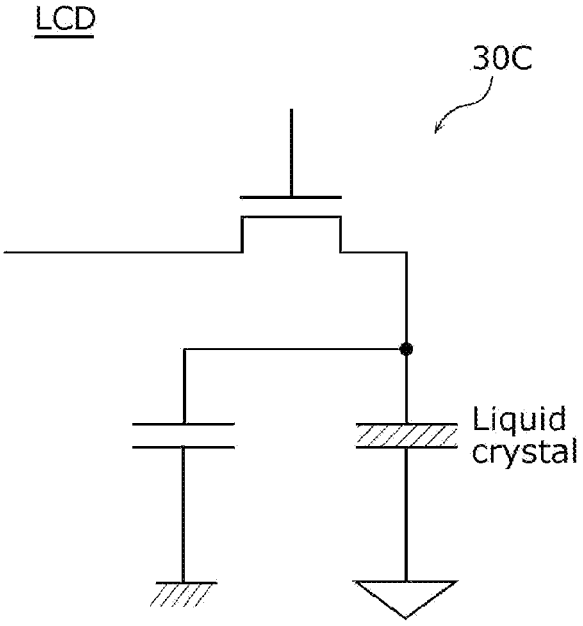
FIG. 24 is a circuit diagram schematically illustrating an example of the configuration of one pixel circuit according to Variation 2 of the embodiment.

FIG. 24 is a circuit diagram schematically illustrating a configuration example of pixel circuit 30C according to Variation 2 of the present embodiment. As illustrated in FIG. 24, pixel circuit 30C does not include a light-emitting device and includes a capacitor, a liquid crystal, a diode, and a drive transistor. That is, pixels in display panel 10 for displaying an image may be liquid crystal devices, or the pixel circuits in display device 1 may be applied to liquid crystals.

In the case where liquid crystals are applied to display device 1, display device 1 may further include backlights for backlight scanning. The term "backlight scanning" as used herein refers to a technique for sequentially turning off backlights in the vicinity of lines including pixels to be rewritten. Liquid crystal backlights are ordinarily not synchronized with video. However, according to this variation, the backlights are synchronized and operated with video during backlight scanning. The emission period is assumed to be a period in which the backlights are turned on for backlight scanning, and the extinction period is referred to as a period in which the backlights are turned off.

Accordingly, even if frame periods for backlight scanning widely vary in length, it is possible to make flicker invisible on the display panel using liquid crystals. That is, even if frame periods vary in length, it is possible to suppress a flicker phenomenon on the display panel using liquid crystals.

Figure 25:
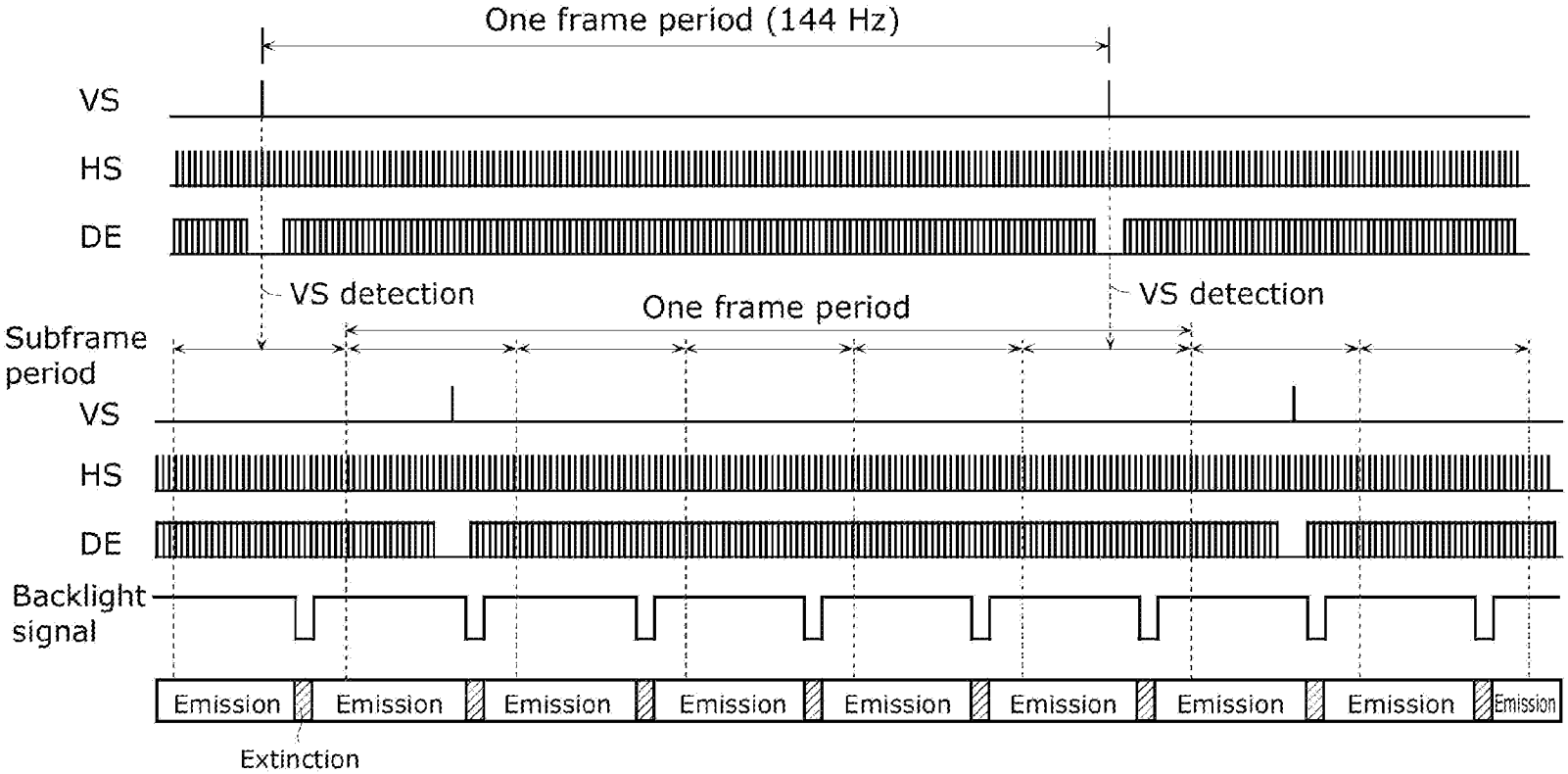
FIG. 25 shows one example of a timing chart illustrating the frame periods for backlight scanning according to Variation 2 of the embodiment.

FIG. 25 shows one example of a timing chart of frame periods for backlight scanning according to Variation 2 of the present embodiment. In FIG. 25, an example case is illustrated in which one frame period is 144 Hz, one subframe period is 720 Hz (1.39 ms), and one frame period includes five subframe periods. The ON state of a backlight signal illustrated in FIG. 25 corresponds to the emission period, and the OFF state of the backlight signal corresponds to the extinction period. The timing chart for the lead line is illustrated in FIG. 25, and backlights before and after lines to be rewritten are turned off.

In this way, even in the case of applying liquid crystals to display device 1, it is possible, by repeating on-duty and off-duty periods of a predetermined length in a fixed cycle called a subframe period, to make flicker invisible on the display panel for displaying an image, even if frame periods vary in length.

OTHER EMBODIMENTS (1) While the above embodiments and variations have described that frame periods having varying lengths are each reconfigured as a plurality of subframe periods of about the same length and executed so as to repeat the emission period and the extinction period at about fixed intervals, the present disclosure is not limited thereto. In the case where a signal indicating the start of a frame period has been detected during execution of the subframe period that is added after the end of the last subframe period, the added subframe period may be stopped before the added subframe period ends, and the next frame period may be started.

Figure 26:
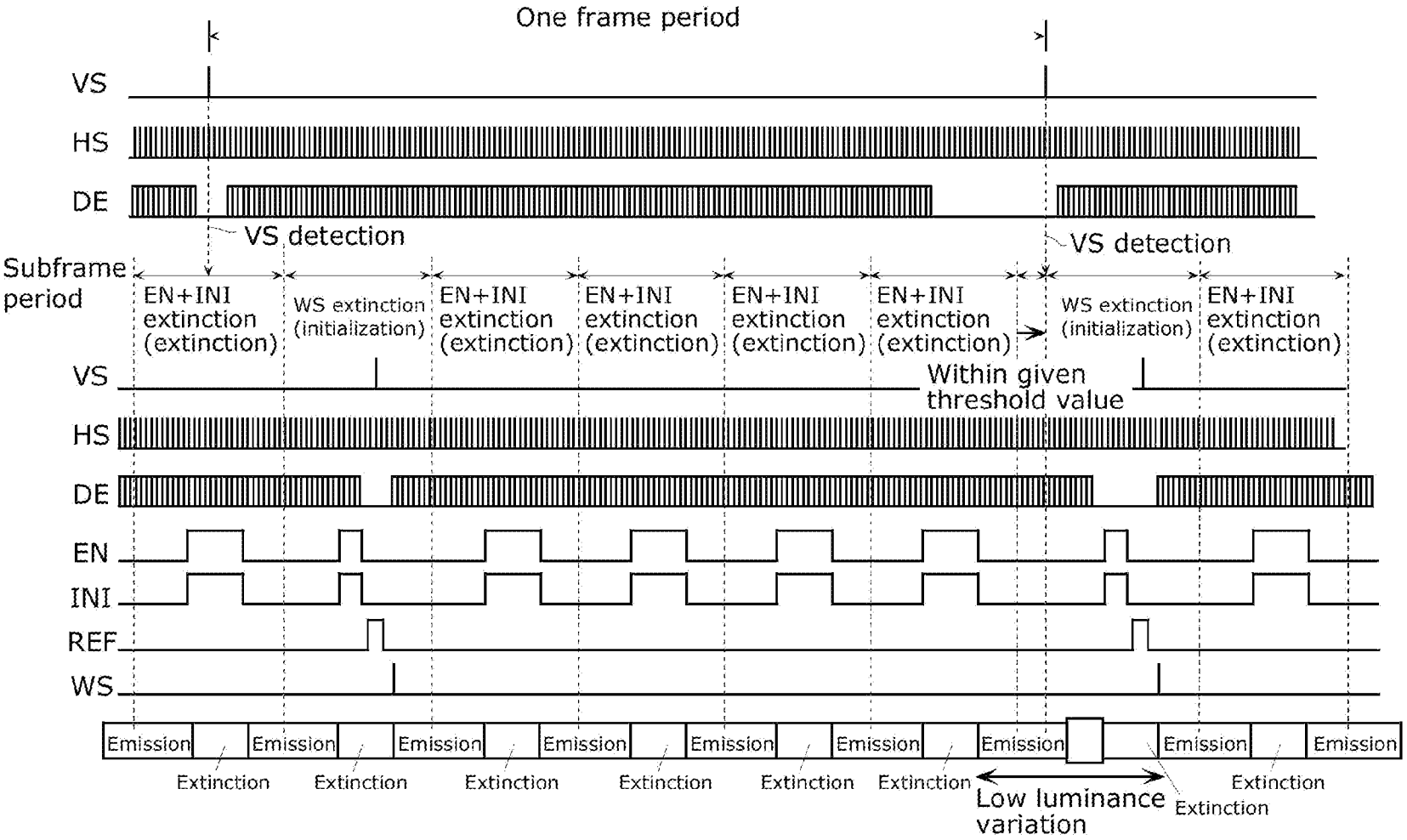
FIG. 26 is a diagram illustrating one example of a detailed operation of controlling the emission period and the extinction period of a frame period, performed by the control device when frame periods vary in length, according to another embodiment.

FIG. 26 is a diagram illustrating one example of a detailed operation of controlling the emission period and the extinction period of the frame period, performed by the control device when frame periods vary in length, according to another embodiment.

In FIG. 26, a signal indicating the start of another frame period has been detected within a threshold value (a time less than or equal to the threshold value) after the start of the added subframe period. Then, the added subframe period is stopped before the added subframe period ends, and the next frame period is started.

More specifically, the frame length of subframe periods is changed, irrespective of a frame period that is input, so that the frame period is reconfigured as n subframe periods, where n is an integer greater than or equal to 2. Then, in the case where a signal indicating the start of the next frame period has been detected during an added subframe period that is executed after the last subframe period and if the timing of detection is within a period of time less than or equal to a given threshold value after the start of the added subframe period, the added subframe period may be stopped before the added subframe period ends, and the next frame period may be started.

In this way, in the case where a signal such as a vertical synchronizing signal has been detected within a period of time less than or equal to the threshold value after the start time of the added subframe period, the added subframe period is stopped before the added subframe period ends, and the first subframe period of the next frame period is started. This increases the length of one frame period, but sufficiently reduces variations in luminance if the range of increase in length is small. Accordingly, it is possible to suppress a flicker phenomenon even if frame periods vary in length.

(2) While the above embodiment and variations have described that each of the subframe periods of a frame period having a varying length is controlled to have substantially the same ratio determined in advance, the present disclosure is not limited thereto. Depending on the light-emitting properties unique to display panel 10, fine adjustments may be made to the duty ratio for each subframe period of the frame periods.

This will be described hereinafter with reference to FIGS. 27A to 29, using as an example a case where one frame period is 144 Hz.

Figure 27A:
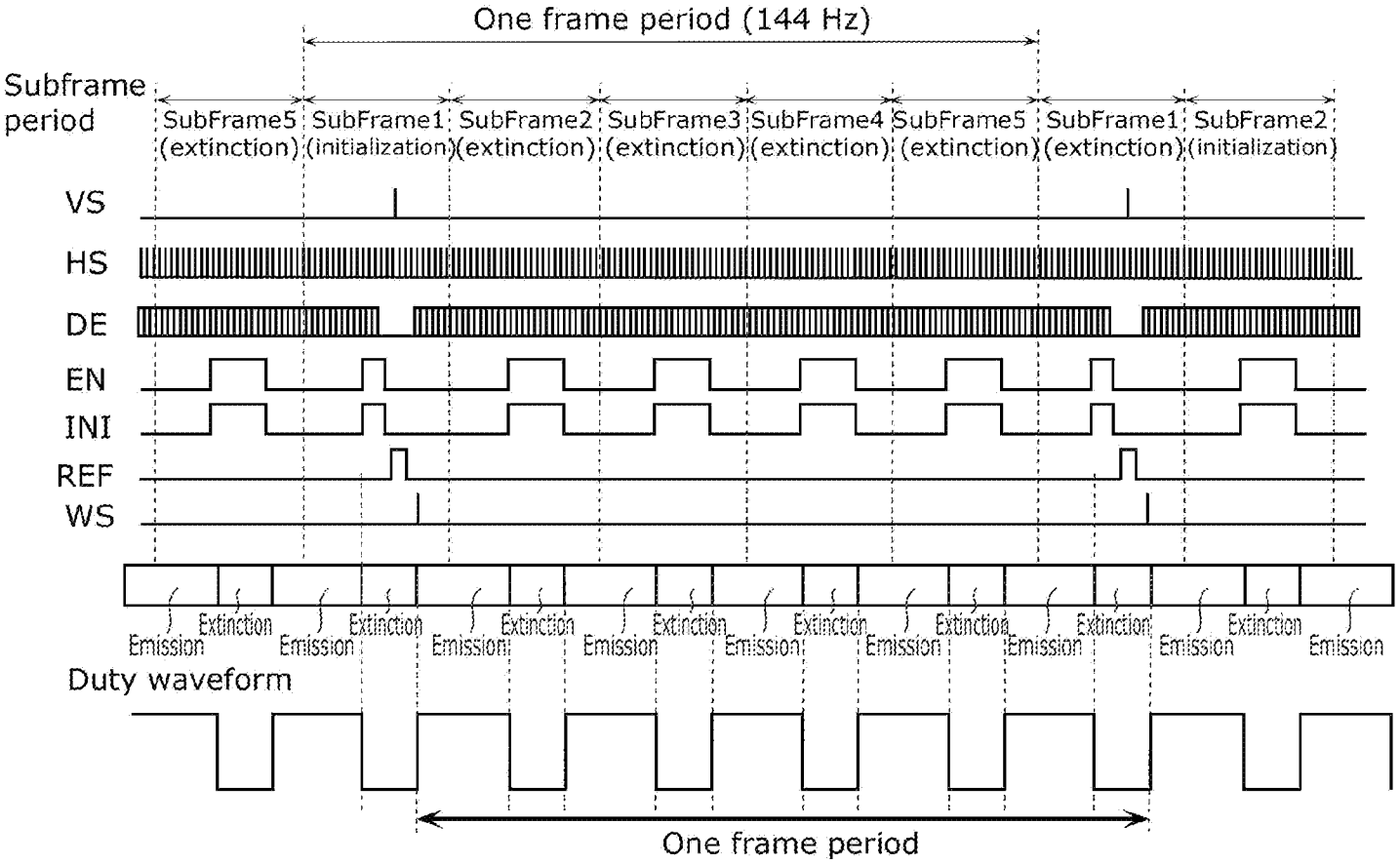
FIG. 27A is a diagram illustrating one example of a duty waveform during a plurality of subframe periods that configure one frame period of 144 Hz.

FIG. 27A is a diagram illustrating one example of a duty waveform during a plurality of subframe periods of a frame period of 144 Hz. Descriptions of parts similar to those in FIG. 13 shall be omitted.

In the example illustrated in FIG. 27A, each of five subframe periods including SubFrame1 (initialization) and SubFrame2 (extinction) to SubFrame5 (extinction) include about a fixed extinction period. In other words, the duty ratio, i.e., the ratio between the emission period and the extinction period, for each of the five subframe periods is controlled to be substantially the same ratio determined in advance. Here, the duty waveform, expressed assuming that the emission period is high and the extinction period is low, becomes the one illustrated in the lowermost part of FIG. 27A.

Figure 27B:
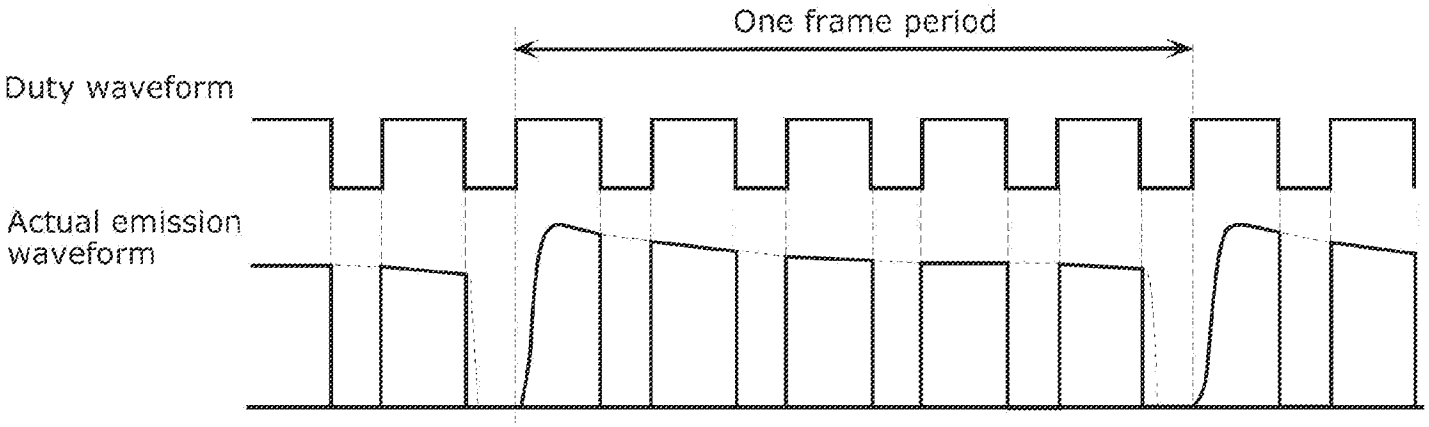
FIG. 27B is a diagram illustrating one example of an actual emission waveform relative to the duty waveform illustrated in FIG. 27A.

FIG. 27B is a diagram illustrating one example of an actual emission waveform relative to the duty waveform illustrated in FIG. 27A. The above embodiment and variations have described that display panel 10 displays an image (video) in accordance with a emission waveform following the duty waveform illustrated in FIG. 27A. However, display panel 10 actually has light-emitting properties unique to itself and therefore displays an image (video) in accordance with the actual emission waveform illustrated in FIG. 27B.

Figure 28:
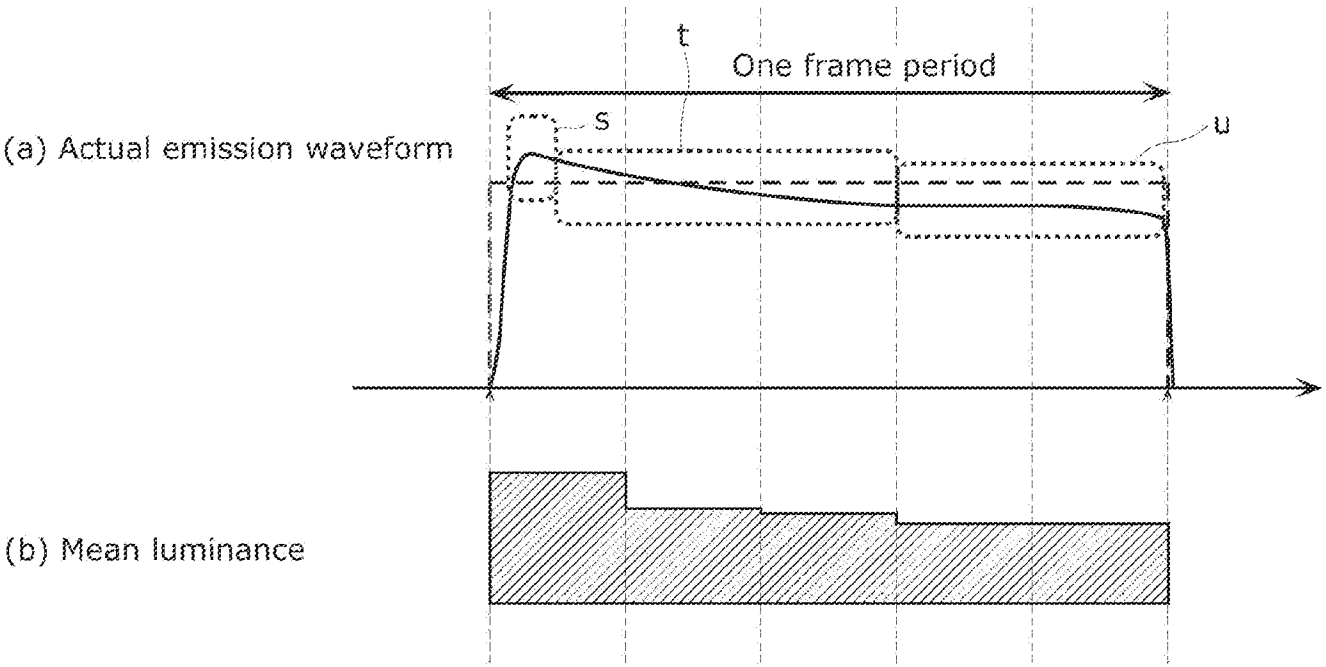
FIG. 28 is a diagram illustrating an actual emission waveform obtained by excluding the extinction period from the actual emission waveform in one frame period illustrated in FIG. 27B, and mean luminance during that period.

FIG. 28 is a diagram illustrating an actual emission waveform obtained by excluding the extinction periods from the actual emission waveform for one frame period illustrated in FIG. 27B, and corresponding mean luminance. The actual emission waveform illustrated in FIG. 28 is blunted, exhibits an overshoot during the first emission period, and gradually decreases (inconstantly) during the subsequent emission periods.

More specifically, in FIG. 28, the emission waveform exhibits an overshoot in an "s" region of the first emission period. This occurs because the parasitic capacitances of light-emitting devices 32 of pixels (pixel circuits 30 in FIG. 2) in display panel 10 have been emptied through the initialization of the pixels performed before the first emission period. Ideally, current corresponding to the signal voltage of the video signal, which is caused to flow through drive transistors 33 by pixel capacitances 38 (Cs) written after the initialization, flow through light-emitting devices 32 during a plurality of emission periods following the initialization. However, in actuality, the parasitic capacitances of light-emitting devices 32 of the pixels are emptied through the initialization before the first emission period, and therefore the parasitic capacitances of light-emitting device 32 are also charged during the first emission period. That is, during the first emission period, current that is larger than the current corresponding to the signal voltage of the video signal by the amount charged to the parasitic capacitances of light-emitting devices 32 flows through light-emitting devices 32. Accordingly, the emission waveform exhibits an overshoot during the "s" region of the first emission period, and the mean luminance becomes higher than target luminance.

On the other hand, in FIG. 28, the emission waveform gradually decreases during a "t" region that spans the first to third emission periods from the middle of the first emission period, and the decrease in the emission waveform is minimized during a "u" region that spans the fourth and fifth emission periods. This will be described using, for example, FIG. 2. Ideally, the charge written to pixel capacitances 38 (Cs) after the initialization is maintained during a plurality of emission periods following the initialization. However, in actuality, the charge written to pixel capacitances 38 (Cs) after the initialization gradually leaks, although the amount of leakage is minimal, and the leakage is suppressed gradually. Thus, the mean luminance gradually decreases during the "t" region with the lapse of time of the emission periods, and then decreases at a considerably gradual speed (or is maintained) during the "u" region with the lapse of time of the emission periods.

Figure 29:
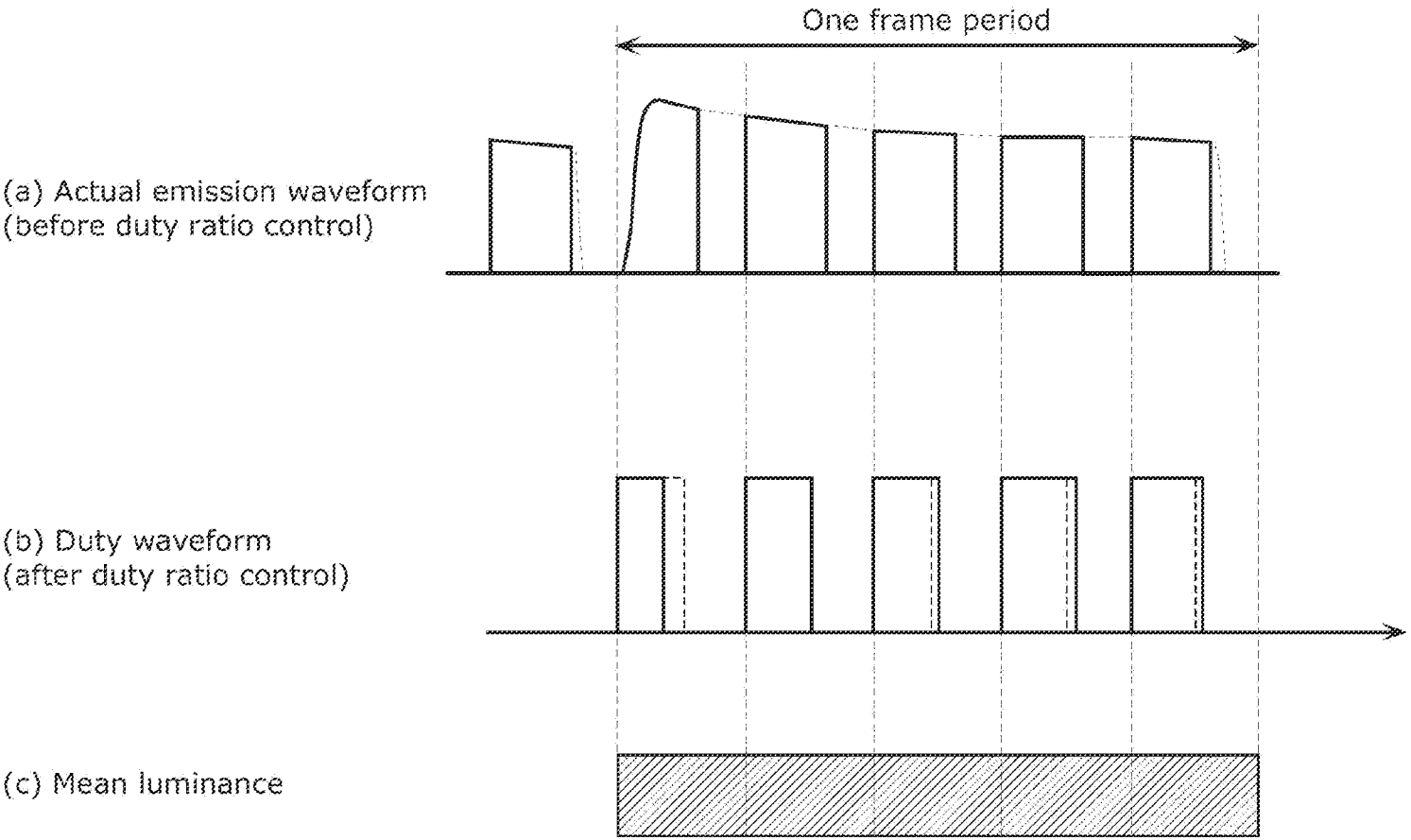
FIG. 29 is a diagram for describing a method of adjusting the duty ratio for each of the plurality of subframe periods according to another embodiment.

In view of this, fine adjustments are made to the duty ratio for each of the subframe periods of the frame period as illustrated in FIG. 29.

FIG. 29 is a diagram for describing a method of adjusting the duty ratio for each of the subframe periods according to another embodiment. The actual emission waveform illustrated in FIG. 27B is illustrated in (a) of FIG. 29. In (b) of FIG. 29, a duty waveform obtained by adjusting the predetermined duty ratio is illustrated relative to the actual emission waveform illustrated in (a) of FIG. 29. In (c) of FIG. 29, mean luminance obtained from the duty waveform having the adjusted duty ratio as illustrated in (b) of FIG. 29 is illustrated.

More specifically, as illustrated in (b) and (c) of FIG. 29, the lengths of the first and third to fifth emission periods are adjusted by adjusting the predetermined duty ratio so as to make the resultant mean luminance constant (uniform).

To be more specific, the duty ratio is adjusted so as to reduce the length of the first emission period having an overshoot. In other words, the duty ratio is adjusted so that the length of the first emission period, i.e., the emission period following the extinction period of the first subframe period among the plurality of subframe periods, becomes shorter than the length determined by the predetermined substantially same duty ratio. This suppresses the influence of the overshoot caused by the light-emitting properties unique to the display panel.

The duty ratio is also adjusted so as to increase the lengths of the third to fifth emission periods in which the emission waveform decreases. Specifically, the duty ratio is adjusted so that the lengths of the fourth and fifth emission periods become longer than the length of the third emission period. This makes the mean luminance illustrated in (c) of FIG. 29 constant.

Note that the duty ratio for each of the subframe periods may be adjusted in accordance with the frame rate, i.e., the length of the frame period. The degree to which the duty ratio for each of the subframe periods depends on the light-emitting properties (actual emission waveform) unique to the display panel, and therefore can be determined at the time of manufacture of the display panel. Thus, the degree to which the duty ratio for each of the subframes is adjusted can be determined in advance for each frame rate.

The decrease in mean luminance caused by the decrease (bluntness) of the actual emission waveform described in FIG. 28 is almost not prominent up to the frame rate of about 60 Hz in the example of the frame periods given in FIG. 12, but becomes prominent at frame rates of 48 Hz and 30 Hz. This is because it becomes impossible to ignore the leakage of pixels (charges of pixel capacitances 38) if the emission periods have lengths at frame rates of about 48 Hz and 30 Hz.

As described above, the duty ratio for each of the subframe periods may be further adjusted in units of subframe periods depending on the frame rate. This suppresses the deviation of the mean luminance from target luminance in each of the subframe periods that configure one frame period due to the light-emitting properties unique to the display panel. Accordingly, it is possible to suppress a flicker phenomenon while suppressing the influence of the light-emitting properties unique to display panel 10.

(3) The present disclosure is not intended to be limited to the configurations described in the above embodiments and variations, and the configuration may be appropriately changed.

While the control method and the control device according to one or a plurality of aspects of the present disclosure have been described based on embodiments, the present disclosure is not limited to these embodiments. One or a plurality of aspects of the present disclosure may also include modes obtained by making various modifications conceivable by those skilled in the art to the embodiments and modes constituted by any combination of constituent elements in different embodiments without departing from the gist of the present disclosure.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is in particular useful in technical fields of, for example, displays for TV systems, game machines, and personal computers that require fast and high-resolution display.

The invention claimed is:

1. A control method for use in a case where frame periods, each being a period in which one image continues to be displayed, vary in length within a given range or temporarily become stable in length on a frame-by-frame basis, and accurate lengths of the frame periods are not known beforehand, the control method comprising:

displaying an image by changing, irrespective of a frame period that is input, a total number of subframe periods so that the frame period is reconfigured as n subframe periods, where n is an integer greater than or equal to 2, wherein each of the n subframe periods has a same duty ratio.

2. The control method according to claim 1, wherein each of the n subframe periods is controlled to become a period of a substantially same length determined in advance.

3. The control method according to claim 1, wherein when a signal indicating start of a frame period is detected during a subframe period, n subframe periods that configure the frame period, where n is an integer greater than or equal to 2, are sequentially executed from a first subframe period, as the frame period, after a predetermined period of time has elapsed since the detection of the signal.

4. The control method according to claim 3, wherein when a signal indicating start of a next frame period after the frame period is detected during execution of a last subframe period of the n subframe periods, the predetermined period of time is a period of time from the detection of the signal indicating the start of a next frame period during the last subframe period to an end of the last subframe period.

5. The control method according to claim 1, wherein a signal indicating start of a frame period that has been detected is a vertical synchronizing signal or a video period signal at a frame head.

6. The control method according to claim 1, wherein when a signal indicating start of a next frame period after the frame period has not been detected during execution of a last subframe period of the n subframe periods, it is determined that the frame period is not an integral multiple of the subframe periods and another subframe period is further started after the end of the last subframe period.

7. The control method according to claim 1, wherein when a signal indicating start of a next frame period after the frame period has not been detected during execution of a last subframe period of the n subframe periods, it is determined that the frame period has not ended yet, and an other subframe period is further started after the end of the last subframe period.

8. The control method according to claim 7, wherein when the start of the next frame period has not been detected, the other subframe period is repeatedly executed.

9. The control method according to claim 1, wherein the frame period is compliant with a standard that makes start timing of imaging variable in accordance with a processing time of a GPU, and a total number of subframes that configure a frame period varies dynamically in accordance with an input video signal.

10. The control method according to claim 1, wherein each of the n subframe periods includes an emission period and an extinction period.

11. The control method according to claim 10, wherein a ratio between the emission period and the extinction period is controlled to become a substantially same ratio determined in advance, the ratio being referred to as the duty ratio.

12. The control method according to claim 11, wherein the duty ratio for each of the n subframe periods that configure the frame period is adjusted in accordance with a light-emitting property of a display panel that displays the image.

13. The control method according to claim 12, wherein in a case of adjusting the duty ratio for each of the n subframe periods, the duty ratio is adjusted to make the emission period following the extinction period of a first subframe period of the n subframe periods shorter than a length determined by the substantially same ratio.

14. The control method according to claim 10, wherein the extinction period of a first subframe period of the n subframe periods includes an initialization period for initializing a plurality of pixel circuits arranged in a matrix and included in a display panel that displays the image.

15. The control method according to claim 1, wherein pixels included in a display panel that displays the image are light-emitting devices including an organic EL device and driven by current to emit light.

16. The control method according to claim 1, wherein pixels included in a display panel that display the image are liquid crystal devices, each of the n subframe periods includes an emission period and an extinction period, the emission period is a period in which a backlight for backlight scanning is on, and the extinction period is a period in which the backlight is off.

17. A control method for use in a case where frame periods, each being a period in which one image continues to be displayed, vary in length within a given range or temporarily become stable in length on a frame-by-frame basis, and accurate lengths of the frame periods are not known beforehand, the control method comprising:

changing, irrespective of a frame period that is input, a total number of subframe periods so that the frame period is reconfigured as n subframe periods, where n is an integer greater than or equal to 2, and when a signal indicating start of a next frame period is detected during an added subframe period that is executed after a last subframe period and if timing of the detection is within a period of time less than or equal to a given threshold value after start of one subframe period, stopping the added subframe period before the added subframe period ends and starting the next frame period.

18. A control device for controlling an emission period and an extinction period of a frame period that is a period in which one image continues to be displayed, the control device comprising:

a duty controller that, when having detected a signal indicating start of a frame period, sequentially starts, as a frame period, a plurality of subframe periods that configure the frame period, from a first subframe period after a predetermined period of time has elapsed since the detection of the signal, wherein the duty controller controls all of the plurality of subframe periods to have a substantially same length determined in advance and to have a substantially same ratio between the emission period and the extinction period, the ratio being referred to as a duty ratio.

19. A control device for use in a case where frame periods, each being a period in which one image continues to be displayed, vary in length within a given range or temporarily become stable in length on a frame-by-frame basis, and accurate lengths of the frame periods are not known beforehand, the control device comprising:

a controller, the controller changing, irrespective of a frame period that is input, a total number of subframes so that the frame period is reconfigured as n subframes, where n is an integer greater than or equal to 2, and when a signal indicating start of a next frame period is detected during an added subframe period that is executed after a last subframe period and if timing of the detection is within a period of time less than or equal to a given threshold value after start of one subframe period, the controller stopping the added subframe period before the added subframe period ends, and starting the next frame period.

* * * * *